US008770683B2

(12) United States Patent
Rehage

(10) Patent No.: US 8,770,683 B2
(45) Date of Patent: Jul. 8, 2014

(54) DRAWER GUIDE FOR A FURNITURE DRAWER COMPONENT

(75) Inventor: Daniel Rehage, Bielefeld (DE)

(73) Assignee: Paul Hettich GmbH & Co. KG, Kirchlengern (DE)

( * ) Notice: Subject to any disclaimer, the term of this patent is extended or adjusted under 35 U.S.C. 154(b) by 0 days.

(21) Appl. No.: 13/203,150

(22) PCT Filed: Feb. 24, 2010

(86) PCT No.: PCT/EP2010/052318

§ 371 (c)(1), (2), (4) Date: Aug. 24, 2011

(87) PCT Pub. No.: WO2010/097400

PCT Pub. Date: Sep. 2, 2010

(65) Prior Publication Data

US 2012/0002907 A1 Jan. 5, 2012

(30) Foreign Application Priority Data

Feb. 25, 2009 (DE) ..... 20 2009 002 715 U

(51) Int. Cl.
*A47B 95/02* (2006.01)

(52) U.S. Cl.
USPC ..... 312/319.1

(58) Field of Classification Search
CPC ..... A47B 88/047; A47B 88/10; A47B 2210/0094; A47B 2088/0444
USPC ..... 312/330.1, 333, 319.1, 334.1, 334.6, 312/334.7, 334.14, 334.27, 334.32, 334.44, 312/334.8, 334.11, 334.31, 334.38; 384/20, 384/18
See application file for complete search history.

(56) References Cited

U.S. PATENT DOCUMENTS 3,658,398 A 4/1972 Abbate, Jr. et al.
4,066,308 A 1/1978 Wedel
4,635,763 A * 1/1987 Omata ..... 188/268

(Continued)

FOREIGN PATENT DOCUMENTS

DE 89827 1/1896
DE 203 11 795 12/2004

(Continued)

OTHER PUBLICATIONS

Transmittal of International Preliminary Report on Patentability for International Application No. PCT/EP2010/052318 and Written Opinion.

(Continued)

*Primary Examiner* — Darnell Jayne
*Assistant Examiner* — Hiwot Tefera
(74) *Attorney, Agent, or Firm* — Barnes & Thornburg, LLP

(57) ABSTRACT

A pullout guide for a furniture pullout part configured to be pulled out from a piece of furniture over a predefined pullout distance. The pullout guide includes a retraction device configured to retract the furniture pullout part at least over a portion of the predefined pullout distance. The retraction device includes a spring configuration having a first spring and a second spring connected in parallel with respect to each other. Each of the first and second springs includes a different spring characteristic curve than the other spring and/or each of the first and second springs includes a different force-distance characteristic acting in a pullout direction of the pullout guide.

12 Claims, 39 Drawing Sheets

(56) References Cited

U.S. PATENT DOCUMENTS

| | | | | |
|---|---|---|---|---|
| 5,040,833 | A * | 8/1991 | Brunnert | 292/80 |
| 5,988,780 | A * | 11/1999 | Rock et al. | 312/334.46 |
| 6,367,899 | B1 * | 4/2002 | Hwang et al. | 312/334.47 |
| 6,585,337 | B1 * | 7/2003 | Chen et al. | 312/334.46 |
| 6,935,710 | B2 * | 8/2005 | Chen et al. | 312/333 |
| 7,101,081 | B2 * | 9/2006 | Chen et al. | 384/21 |
| 7,210,198 | B2 * | 5/2007 | Hoshide et | 16/96 R |
| 7,249,813 | B2 * | 7/2007 | Gasser | 312/333 |
| 7,399,041 | B2 * | 7/2008 | Prentner et al. | 312/333 |
| 7,481,505 | B2 * | 1/2009 | Orita | 312/333 |
| 7,980,641 | B2 * | 7/2011 | Huang et al. | 312/334.46 |
| 8,118,378 | B2 * | 2/2012 | Wei et al. | 312/333 |
| 8,182,054 | B2 * | 5/2012 | Liang et al. | 312/333 |
| 8,393,692 | B2 * | 3/2013 | Yu et al. | 312/333 |
| 8,469,468 | B2 * | 6/2013 | Chen et al. | 312/333 |
| 2002/0089274 | A1 * | 7/2002 | Liang et al. | 312/334.44 |
| 2005/0062378 | A1 | 3/2005 | Wojcik | |
| 2005/0093406 | A1 * | 5/2005 | Yang | 312/333 |
| 2006/0029304 | A1 * | 2/2006 | Chen et al. | 384/18 |
| 2006/0082266 | A1 | 4/2006 | Le et al. | |
| 2007/0046158 | A1 * | 3/2007 | Hoffman | 312/333 |
| 2007/0090735 | A1 | 4/2007 | Hashemi et al. | |
| 2007/0164645 | A1 * | 7/2007 | Chen et al. | 312/334.47 |
| 2007/0170829 | A1 * | 7/2007 | Chen et al. | 312/334.1 |
| 2008/0100190 | A1 * | 5/2008 | Yang et al. | 312/333 |
| 2010/0164340 | A1 * | 7/2010 | Juan et al. | 312/333 |
| 2010/0293746 | A1 * | 11/2010 | Johansson et al. | 16/85 |
| 2013/0055543 | A1 * | 3/2013 | Rotter | 29/428 |

FOREIGN PATENT DOCUMENTS

| | | |
|---|---|---|
| DE | 203 19 598 | 6/2005 |
| DE | 20 2005 015 529 | 3/2007 |
| DE | 10 2007 009 076 | 8/2008 |
| EP | 1 470 769 | 10/2004 |
| EP | 1 755 423 | 2/2007 |
| GB | 2 398 732 | 9/2004 |
| GB | 2 409 402 | 6/2005 |
| WO | 2005/012678 | 2/2005 |

OTHER PUBLICATIONS

English Translation of the International Preliminary Report on Patentability for International Application No. No. PCT/EP2010/052318 and Written Opinion.

German Office Action dated Jan. 28, 2010.

* cited by examiner

R ≙ resulting
Z ≙ tension spring
B ≙ torsion spring

DRAWER GUIDE FOR A FURNITURE DRAWER COMPONENT

This application is a national stage of International Application PCT/EP2010/052318, filed Feb. 24, 2010, and claims benefit of and priority to German Patent Application No. 20 2009 002 715.5, filed Feb. 25, 2009, the content of which Applications are incorporated by reference herein.

BACKGROUND AND SUMMARY

The present disclosure relates to a pullout guide for a furniture pullout part configured to be pulled out from a piece of furniture over a predefined distance.

Such pullout guides are known. It is also known from EP 0 1755 423 B1 that the spring configuration comprises two coiled springs situated parallel to one another, which changes the spring characteristic in relation to a spring configuration having only one spring.

Proceeding from this known pullout guide, the present disclosure further relates to providing an improved pullout guide, which has an advantage of improved operation and an optimized operating characteristic in relation to the prior art.

The present disclosure provides for a pullout guide for a furniture pullout part configured to be pulled out from a piece of furniture over a predefined pullout distance. The pullout guide includes a retraction device configured to retract the furniture pullout part at least over a portion of the predefined pullout distance. The retraction device includes a spring configuration having a first spring and a second spring connected in parallel with respect to each other. Each of the first and second springs includes a different spring characteristic curve than the other spring. Each of the first and second springs may include a different force-distance characteristic acting in a pullout direction of the pullout guide. The present disclosure also provides for a retraction device for a pullout guide for a furniture pullout part that is configured to be pulled out from a piece of furniture over a predefined pullout distance. The retraction device includes a spring configuration configured to retract the furniture pullout part over at least a portion of the predefined pullout distance. The spring configuration includes a first and a second spring connected in parallel with respect to each other and each of the first and second springs includes a different spring characteristic curve than the other spring. The spring configuration may also include a first and a second spring connected in parallel with respect to each other and each of the first and second springs include a different force-distance characteristic acting in a pullout direction of the pullout guide.

In accordance with an embodiment of the present disclosure and as noted above, the spring configuration has at least two springs connected in parallel to one another having different spring characteristic curves.

Further, according to another embodiment of the present disclosure and as noted above, the spring configuration has at least two springs connected in parallel to one another having different force-distance characteristics acting in the pullout direction.

The present disclosure also relates to a retraction device for a pullout guide for a furniture pullout part that is configured to be pulled out from a piece of furniture over a predefined pullout distance. The retraction device includes a spring configuration configured to retract the furniture pullout part over at least a portion of the predefined pullout distance. The spring configuration includes a first spring and a second spring connected in parallel with respect to each other and each of the first and second springs includes a different spring characteristic curve than the other spring. The spring configuration may include a first and a second spring connected in parallel with respect to each other and each of the first spring and second spring includes a different force-distance characteristic acting in a pullout direction of the pullout guide.

The embodiments of the present disclosure provide, in a simple way, a more uniform force-distance curve during opening and also during closing of the furniture pullout part, for example, a drawer. This results in more uniform, pleasant handling and optimized operation. This result is achieved, for example, by a parallel connection of different springs, for example, a tension spring and a torsion spring. These springs may have, for example, contrary spring characteristic curves when the effective horizontal force is observed.

A first spring, for example, may be a coiled spring which acts as a tension or compression spring during retraction of the furniture pullout part. This is known, according to the prior art, for implementing self retractor devices, since it can be housed compactly and is well suitable for causing or at least supporting the retraction of the drawer.

The second spring, for example, may be designed as a torsion spring which acts as a tension or compression spring during retraction of the furniture pullout part. A torsion spring is suitable for the purpose of advantageously supplementing or changing the force-distance characteristic of the first spring. In addition, it is cost-effectively producible and can be integrated extremely simply in the retraction device, without its fundamental structure having to be noticeably changed.

The torsion spring, for example, comprises a spring steel wire, which may have a rectangular or round cross-section.

According to an embodiment of the present disclosure, the first spring is designed in such a way that the retraction force of the first spring decreases over its active retraction distance with the retraction of the drawer. In addition, it is then expedient if the retraction force of the second spring increases over a part of the retraction distance with the retraction of the drawer, or if the retraction force of the second spring is initially negative over its active retraction distance, that is, the force of the tension spring decreases somewhat, that is, not excessively strongly, and then increases with the retraction of the drawer. The retraction force of the second spring corresponds to its horizontal force component. Furthermore, for example, for a fixing on two points, individual areas of the second spring can advantageously be equipped with different spring characteristic curves, similarly to a constant force spring. Therefore, through targeted change of these individual spring characteristic curves, a desired force-distance characteristic of the second spring can be achieved. For a fixing on two points, the traveling "torsion shaft" resulting because of the sliding movement of the pin on the slide is to be located in front of the pin. It is within the scope of the present disclosure that the retraction force of the second spring is initially negative over its effective retraction distance and then increases with the retraction of the drawer when the "bending shaft" is initially located behind and later in front of the pin of the slide.

Furthermore, it is within the scope of the present disclosure to make the second spring two-armed and attached symmetrically to the housing, in order to counteract possible tilting of the slide.

According to an embodiment of the present disclosure, the springs are designed such that the resulting retraction force from the parallel connection in the retraction direction remains constant, or, for example, nearly constant, over the entire retraction distance, which results an advantageous movement behavior.

Furthermore, the following features, according to the present disclosure, contribute individually or in combination to advantageous movement behavior:

the design is such that the force of the torsion spring on the slide has a horizontal component and a vertical component;

the design is such that the vertical force component decreases over the retraction distance;

the design is such that the horizontal force component increases in the retraction direction over the retraction distance;

the design is such that the torsion spring only exerts a vertical force on the slide at the beginning of the retraction distance; and the design is such that the torsion spring only exerts a horizontal force on the slide at the end of the retraction distance.

Additional features according to the present disclosure are discussed herein and stated in the accompanying claims.

Other aspects of the present disclosure will become apparent from the following descriptions when considered in conjunction with the accompanying drawings.

DETAILED DESCRIPTION

Figure 16:
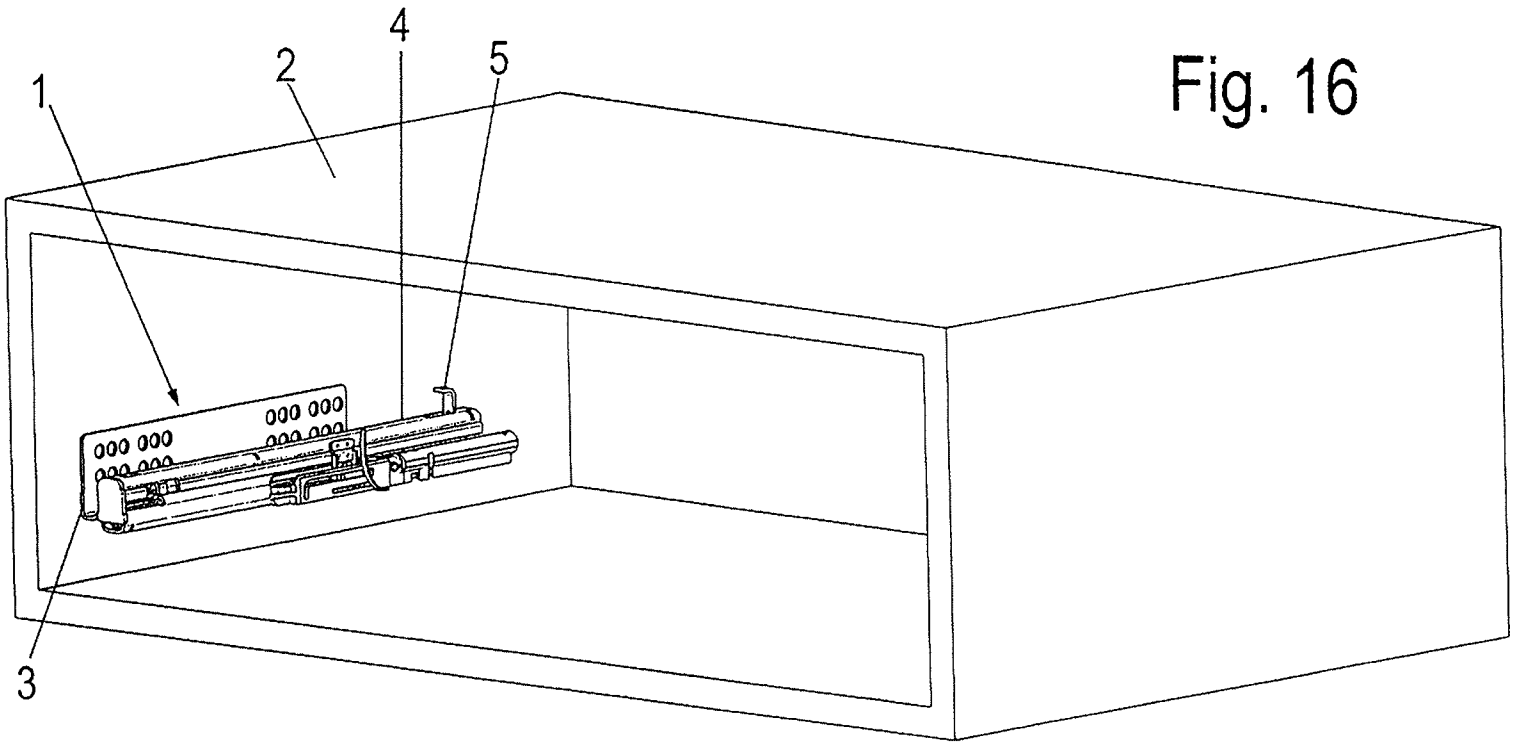
FIG. 16 shows a furniture body having the pullout guide of FIG. 1.

A pullout guide for a furniture pullout part, for example, a drawer (not shown) of a furniture body 2 (see FIG. 16) is identified by numerical designation 1.

The pullout guide 1 is used for vertical support and for guiding the furniture pullout part. The pullout guide includes a body angle 3, a guide rail 10, an optional middle rail, and a slide rail 4 for the support of the furniture pullout part, which is held here using a catch hook 5 on the slide rail 4.

Using the pullout guide 1, the furniture pullout part, which may be in the form of a drawer, for example, can be horizontally pulled out in a way known over a predefined distance in the pullout direction X.

In order that the furniture pullout part is drawn into its maximum retraction position, the pullout guide 1 is provided with a retraction device 6, which acts between two parts of the pullout guide 1 movable relative to one another. The retraction device 6 includes a spring configuration 7 having two springs 8, 9, shown, for example, in FIG. 17.

Figure 1:
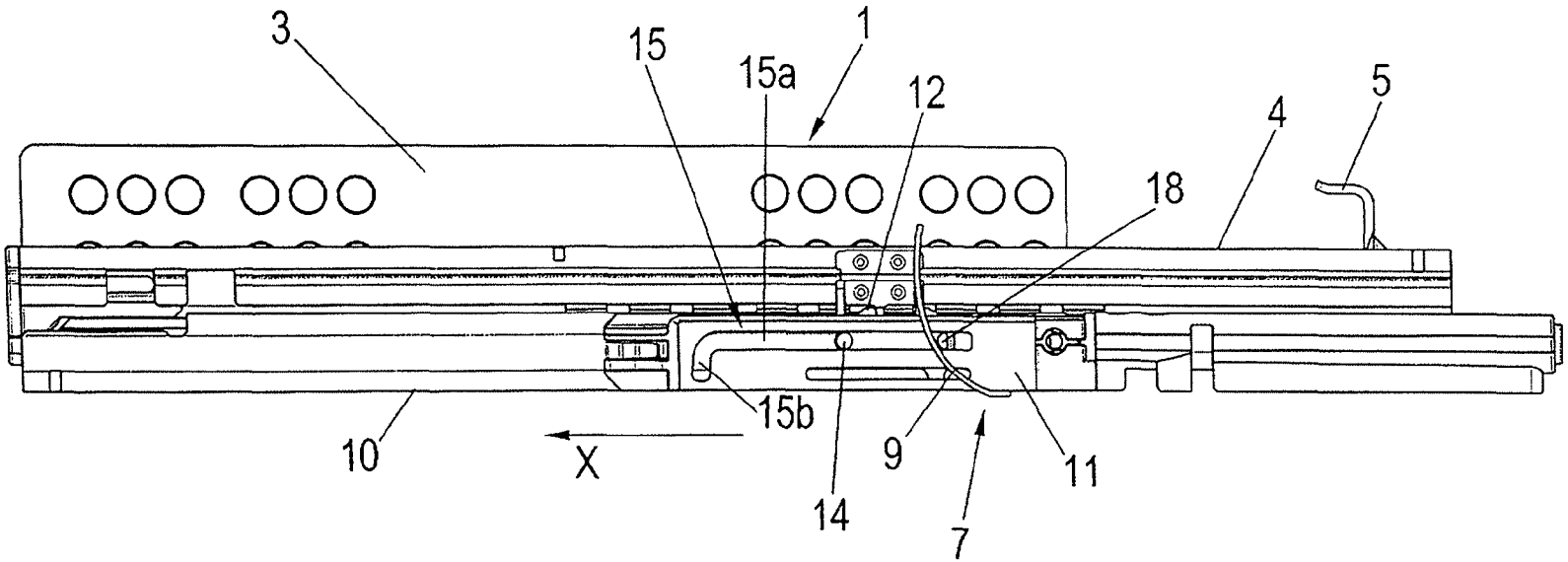
FIG. 1 shows a side view of a pullout guide having a retraction device in the closed state of a furniture pullout part such as a drawer, according to the present disclosure.
Figure 2:
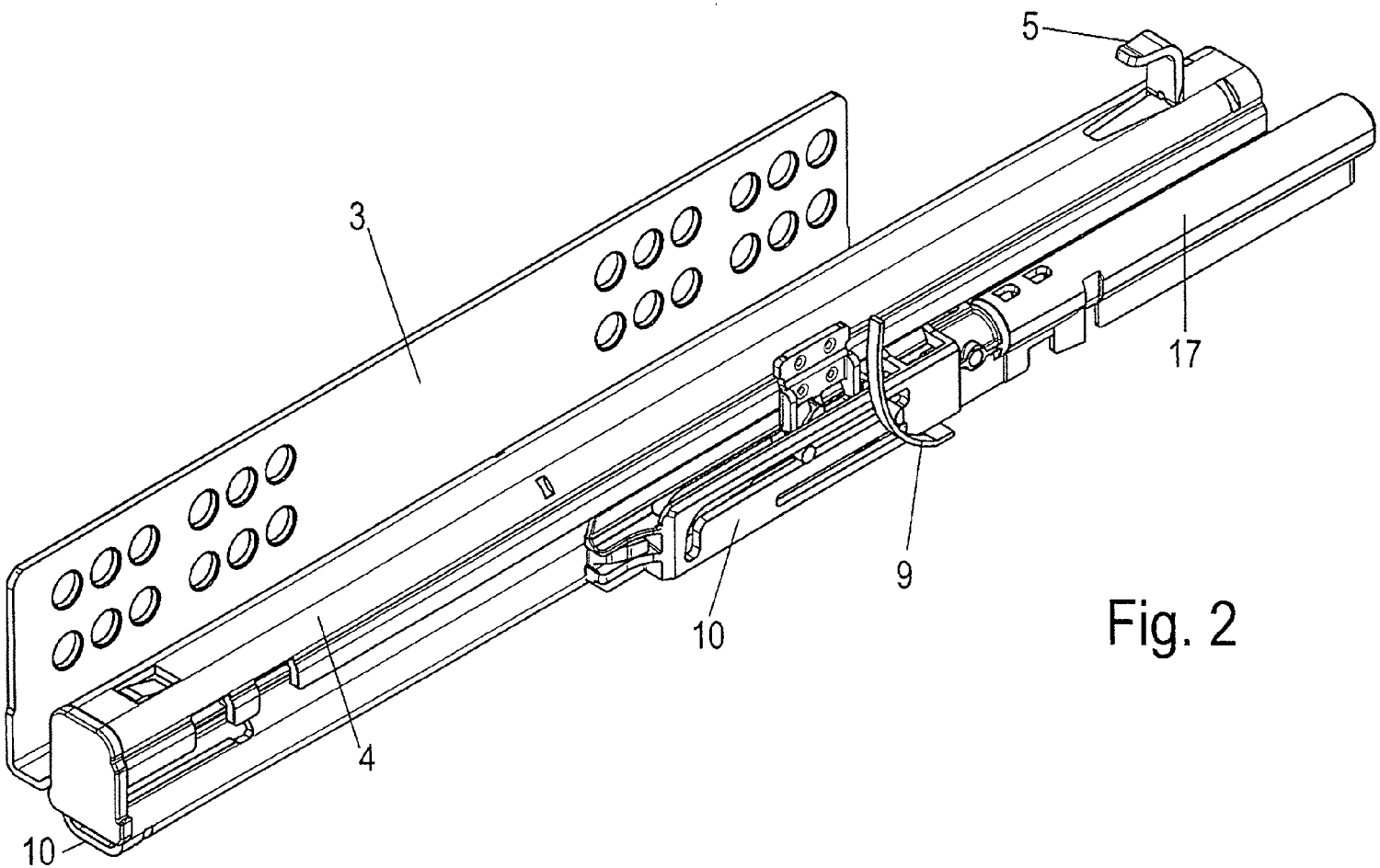
FIG. 2 shows a perspective view of the configuration from FIG. 1 from the front in the closed state of the drawer.
Figure 3:
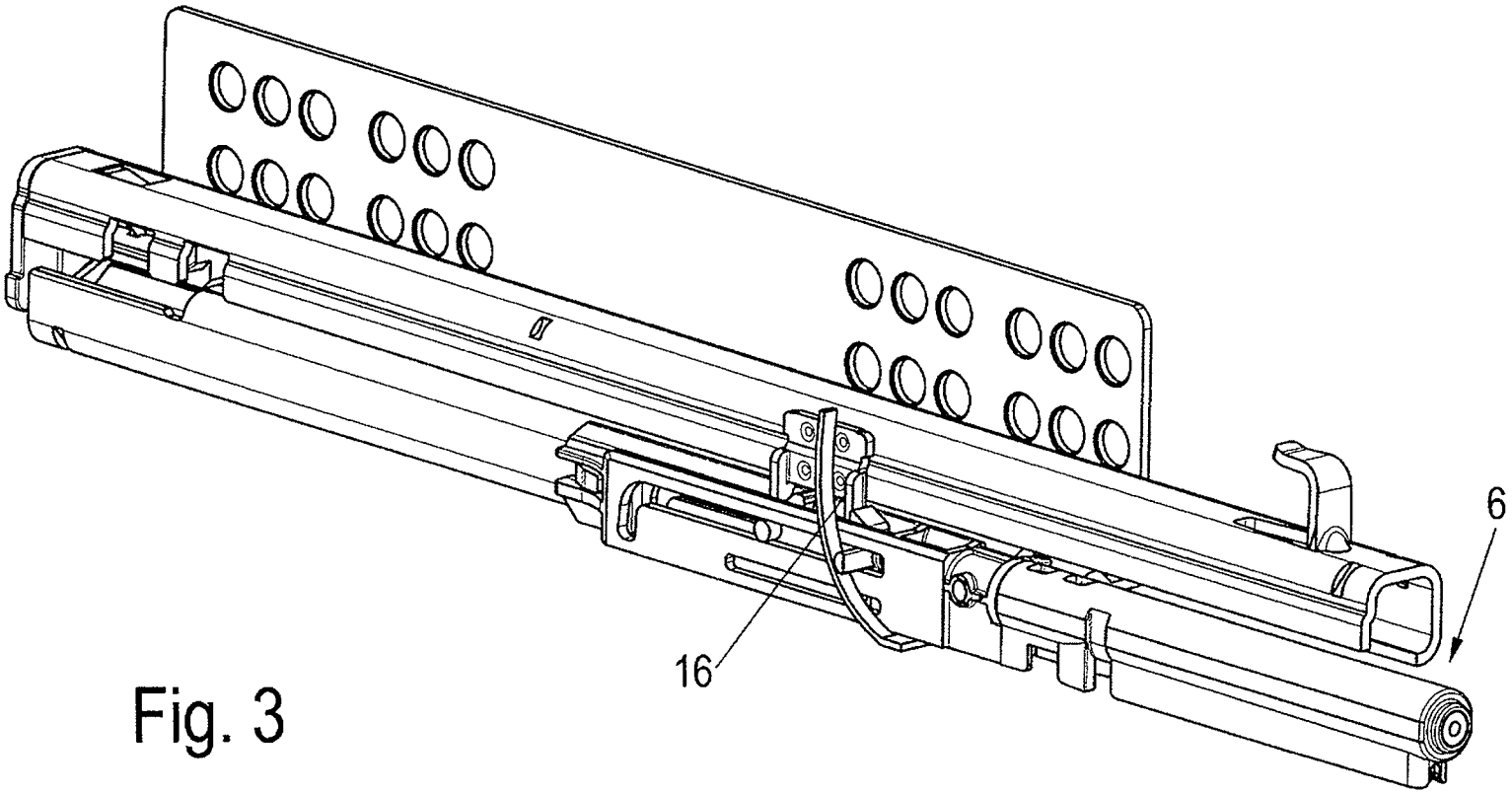
FIG. 3 shows a perspective view of the configuration from FIG. 1 from the rear of the pullout guide in the closed state of the drawer.

The retraction device 6 includes a base or housing 11, using which housing 11, the retraction device 6 is fixed on the guide rail 10 of the furniture body 3, as shown, for example, in FIGS. 1 to 3.

A slide 12 having a receptacle 13, which is open toward the slide rail 4, is guided so it is movable in or on the housing 11.

Figure 4:
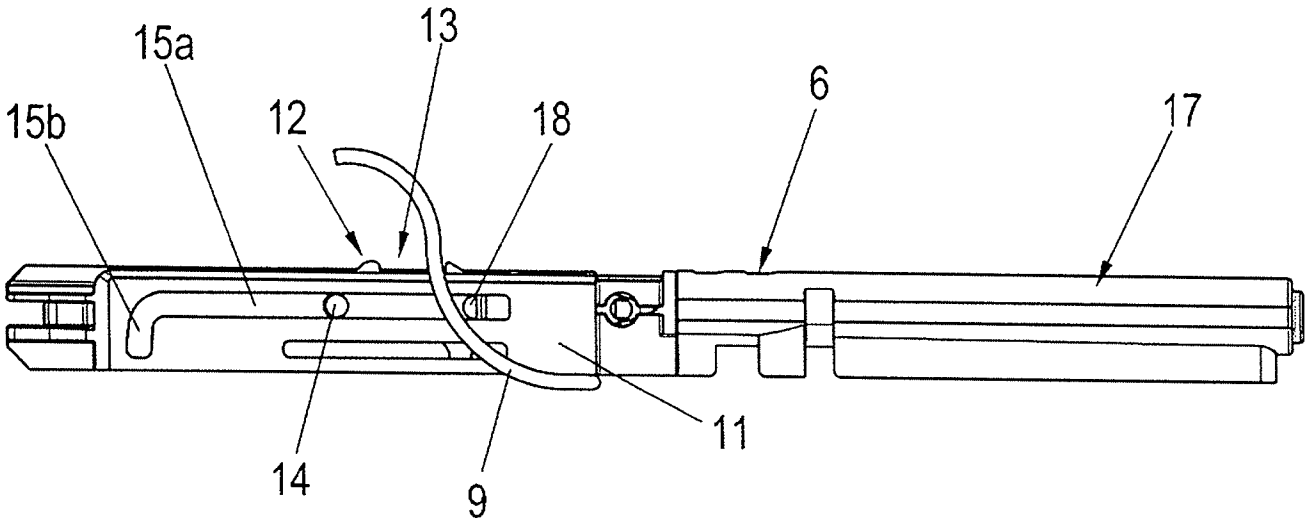
FIGS. 4-6 show various views of a second retraction device, according to the present disclosure, for a pullout guide of the type in FIG. 1.

The slide 12 engages, for example, using a lateral pin 14 in a guide, such as a guide slot 15 which has a linear section 15*a* extending parallel to the pullout direction X and a curved section 15*b* adjoining the linear section 15*a* toward the front side of the furniture or in the pullout direction, as shown, for example, in FIGS. 1 and 4.

A driver 16 of the slide rail 4 engages in the receptacle 13 of the slide (see FIGS. 2 and 3).

The spring configuration 7 acts between the base, or housing, 11 of the retraction device 6 and the slide 12.

Figure 17:
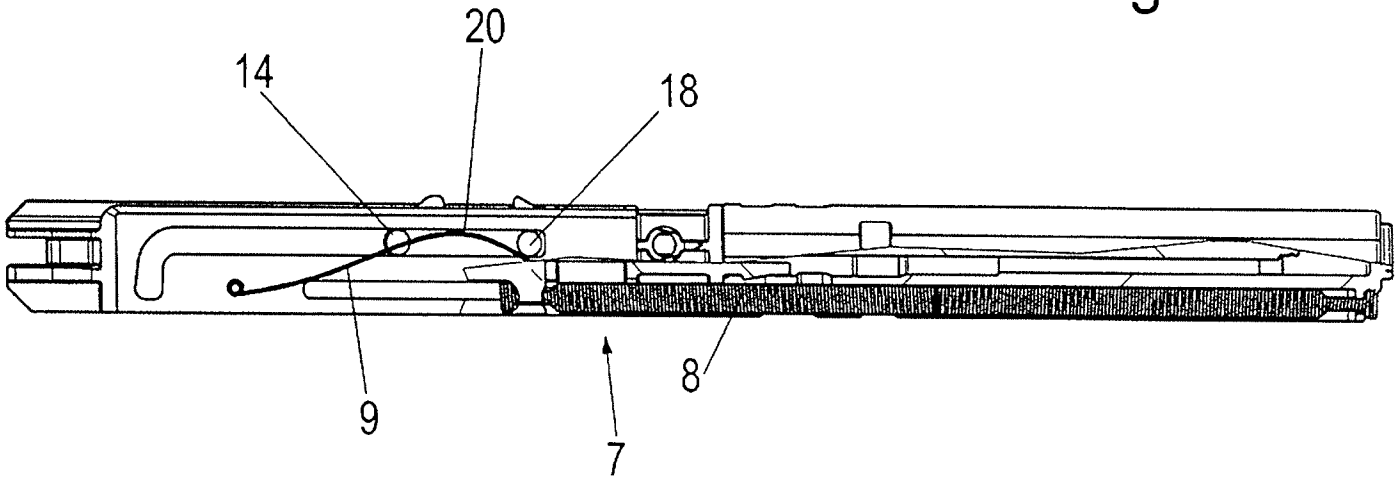
FIG. 17 shows a view of a fourth retraction device having a partially cutaway housing; the pullout guide being in the closed state of the drawer, according to the present disclosure.
Figure 18:
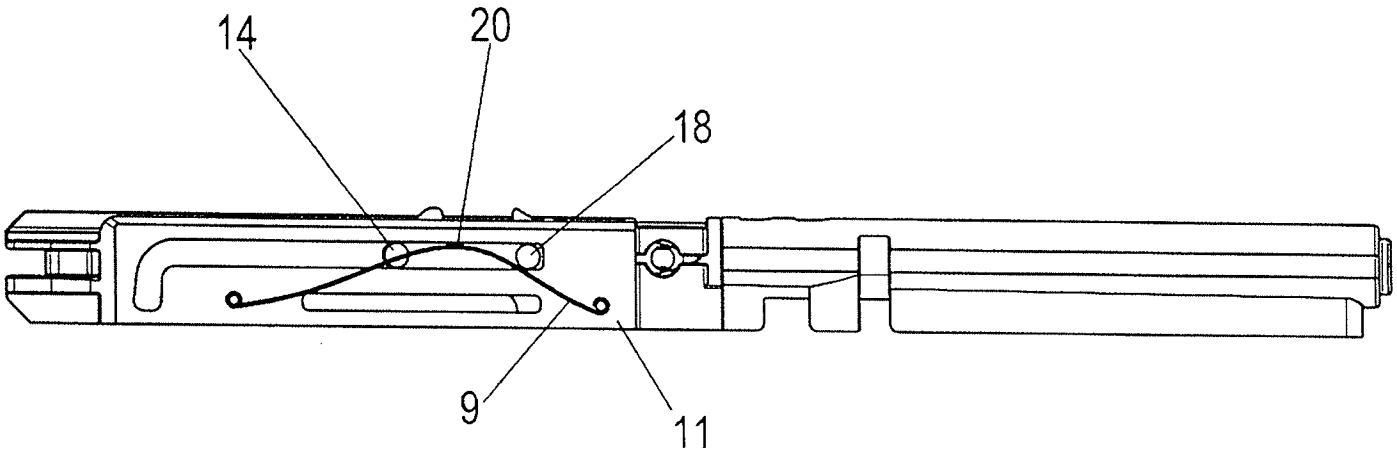
FIGS. 18-20 show various views of the retraction device of the pullout guide of FIG. 17.
Figure 19:
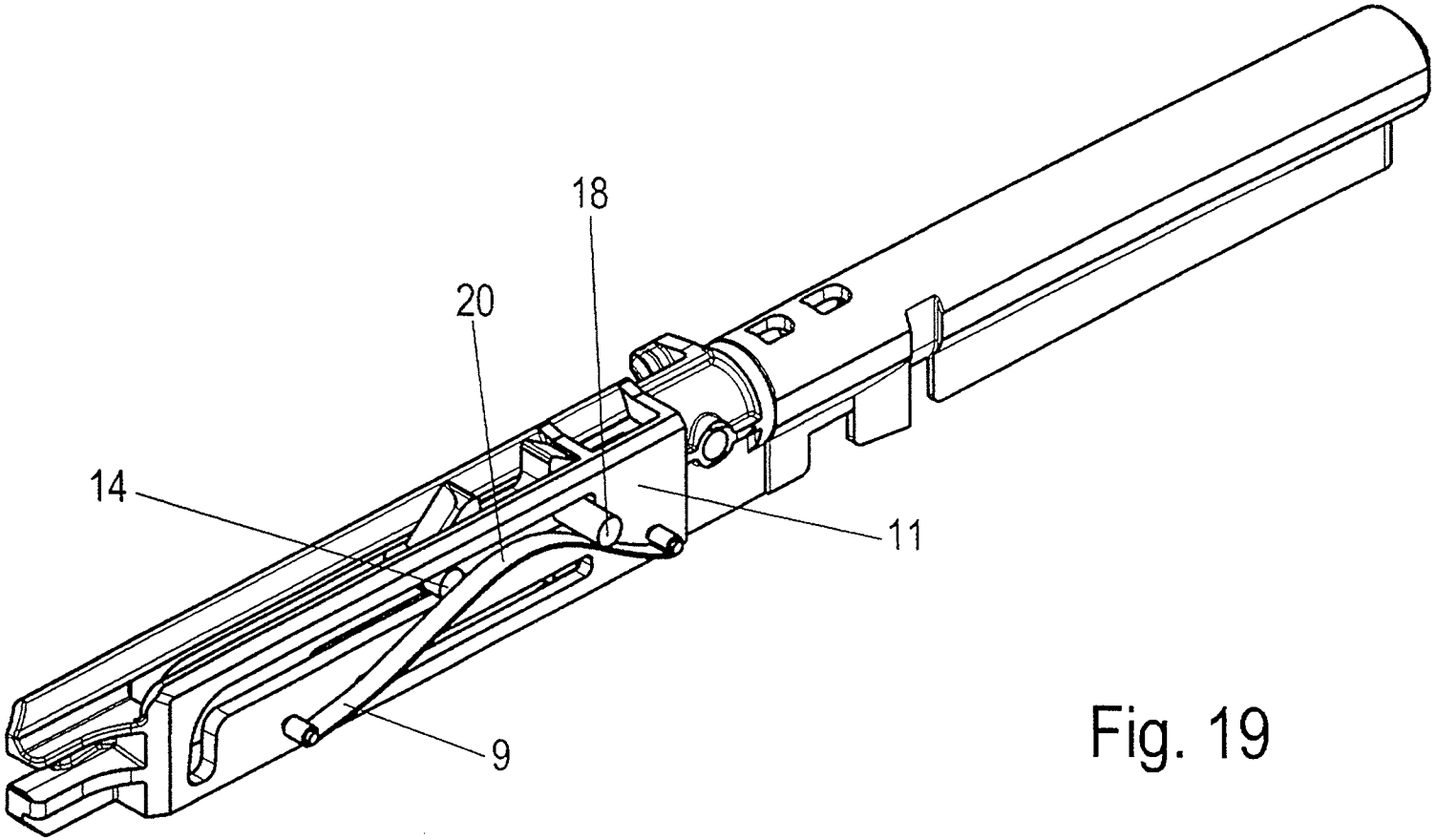
Figure 20:
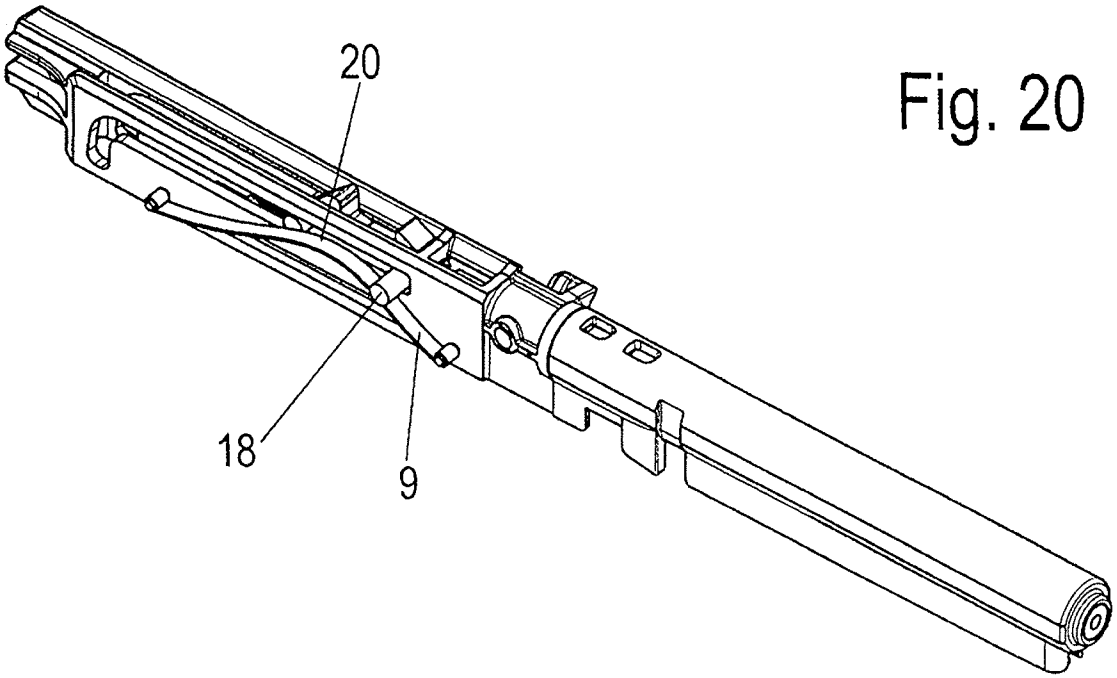
Figure 21:
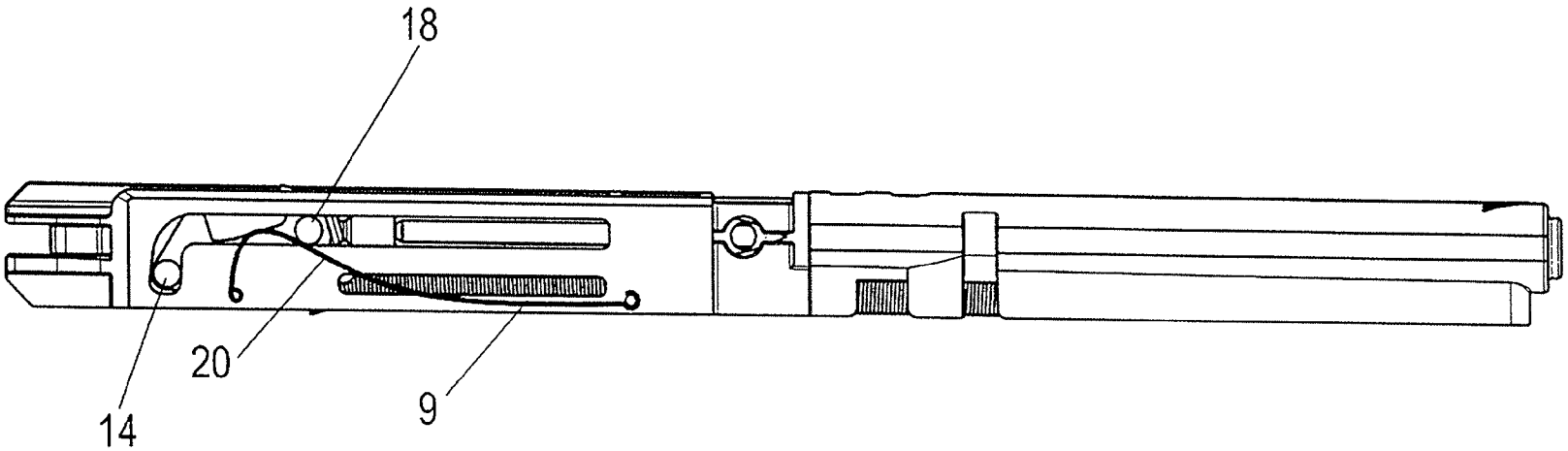
FIGS. 21-23 show various views of the retraction device of the pullout guide of FIG. 17, the pullout guide being in the slightly open state of the drawer.
Figure 22:
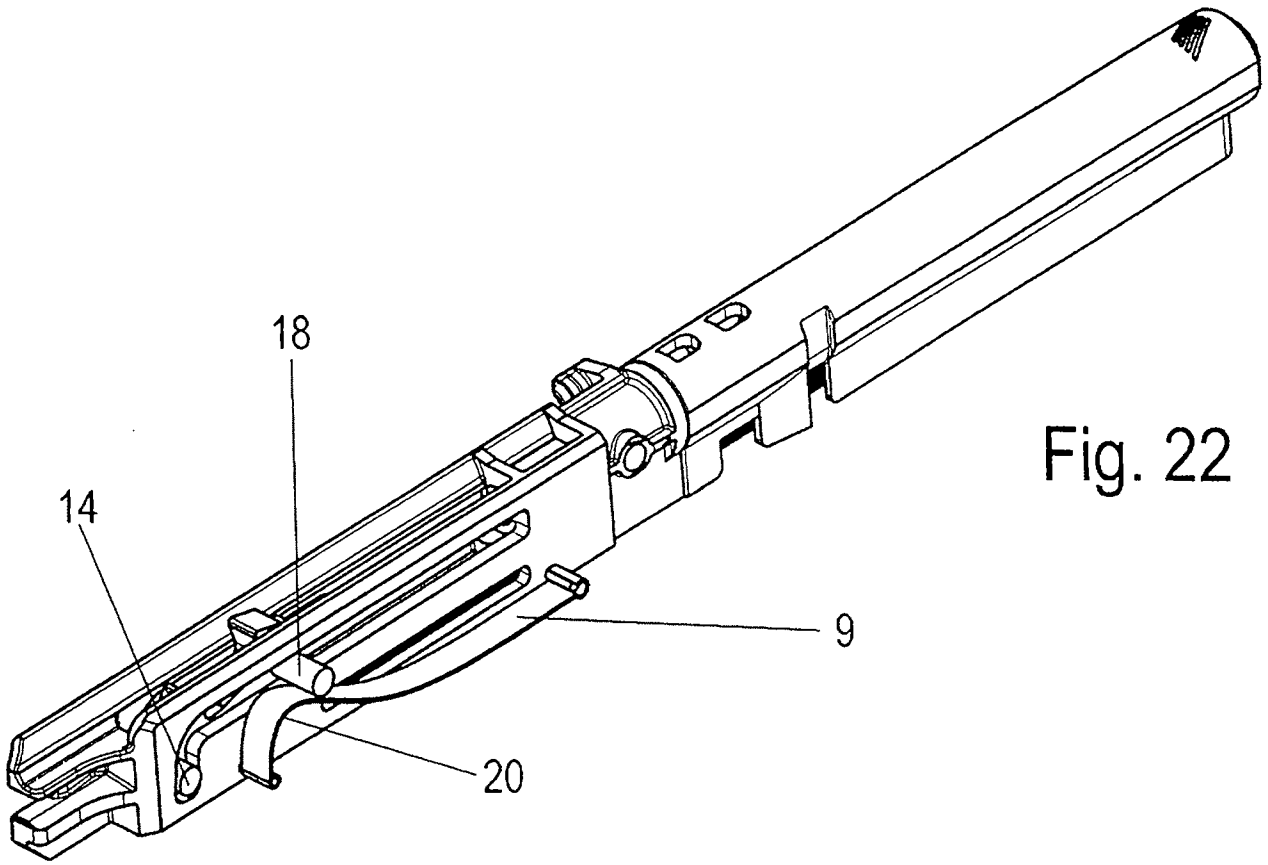
Figure 23:
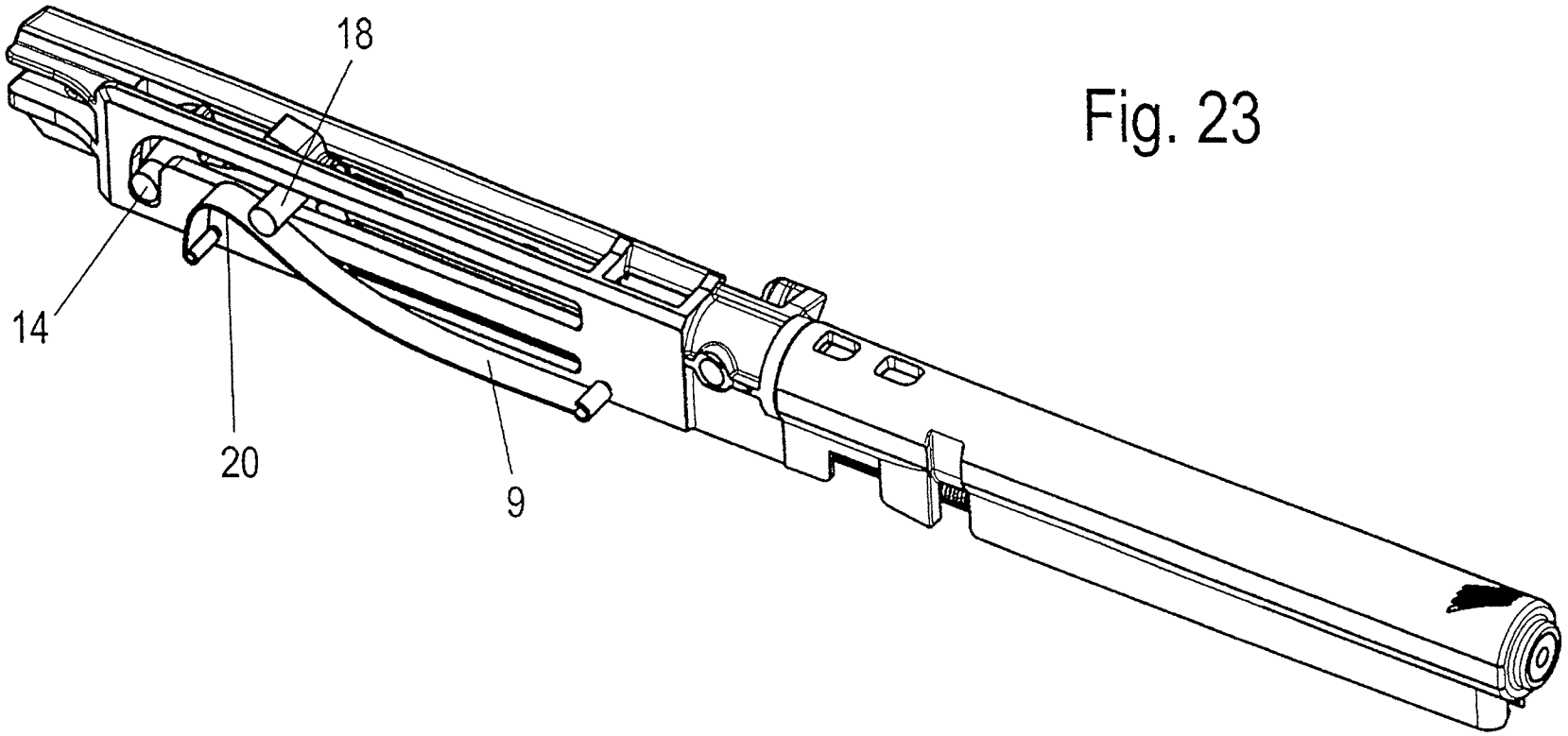
Figure 24:
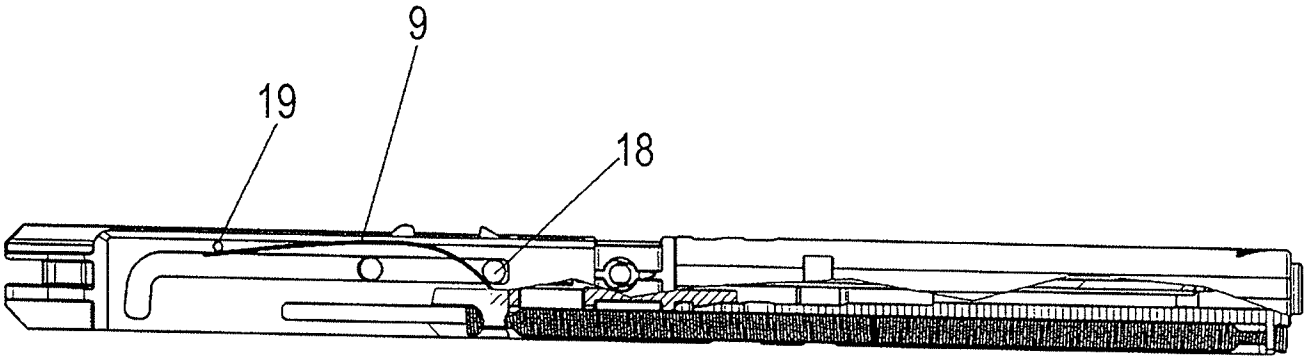
FIG. 24 shows a view of a fifth retraction device having a partially cutaway housing, the pullout guide being in the closed state of the drawer, according to the present disclosure.
Figure 25:
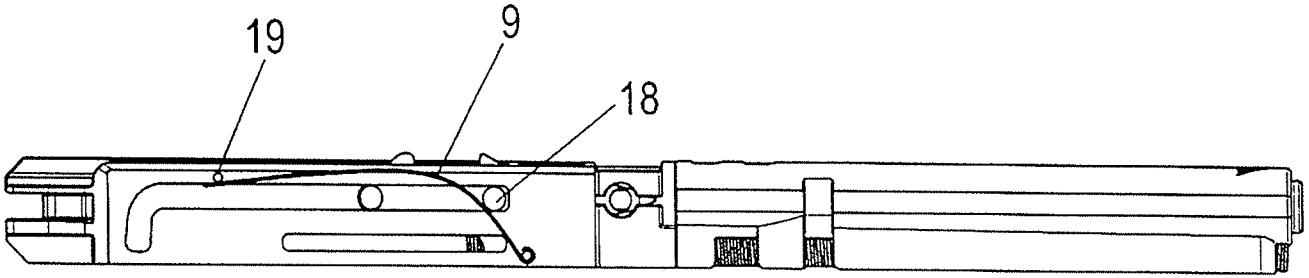
FIGS. 25-27 show views of the retraction device of the pullout guide of FIG. 24.
Figure 26:
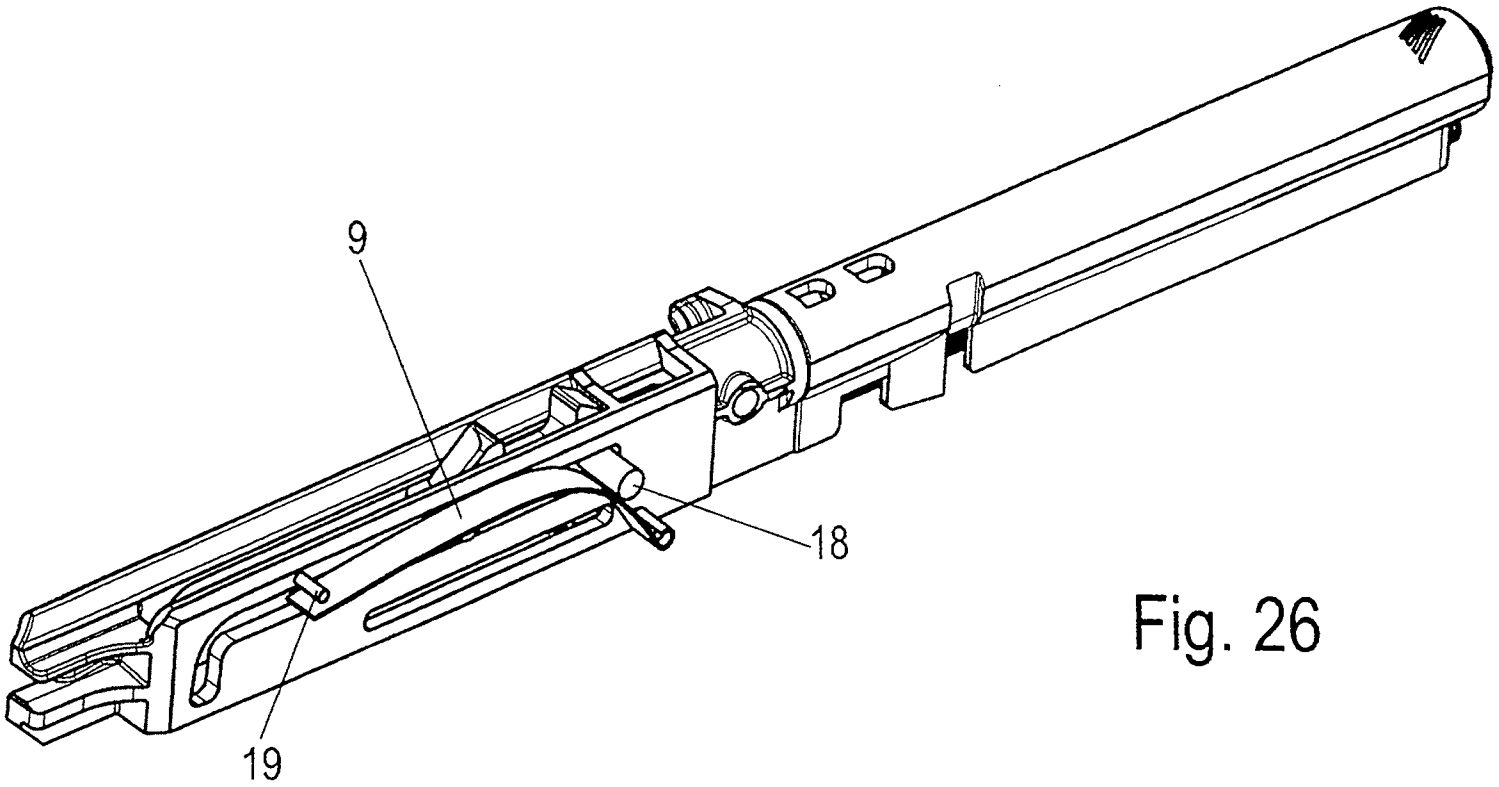
Figure 27:
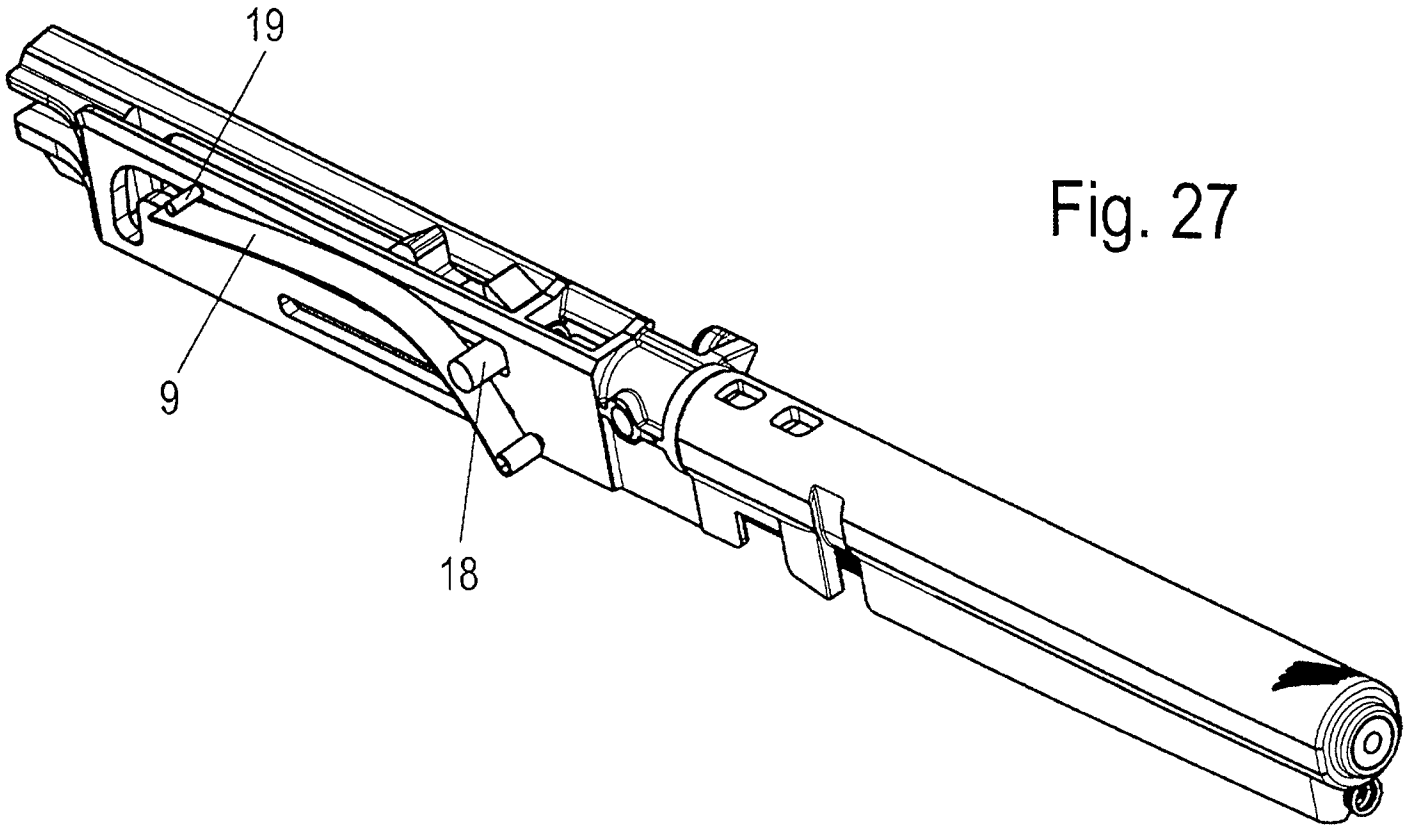
Figure 28:
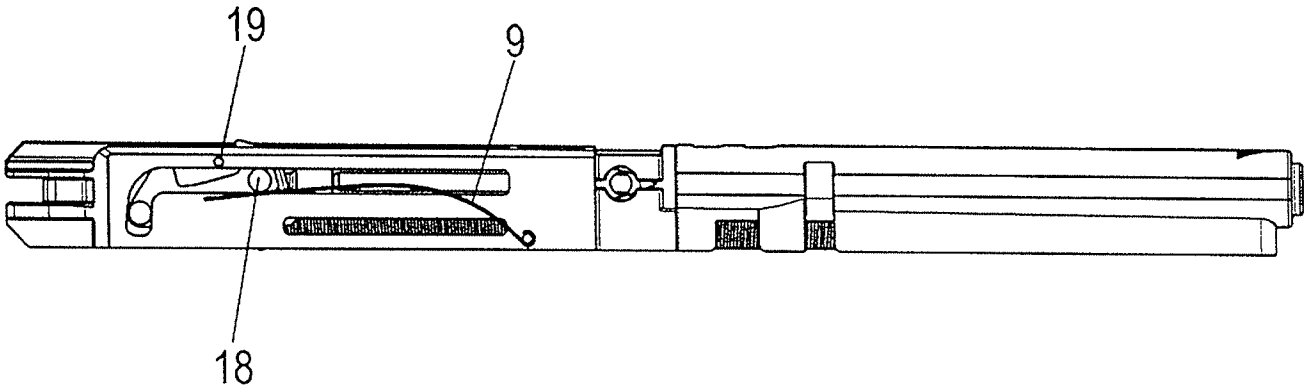
FIGS. 28-30 show views of the retraction device of the pullout guide of FIG. 24, the pullout guide being in the slightly open state of the drawer.
Figure 29:
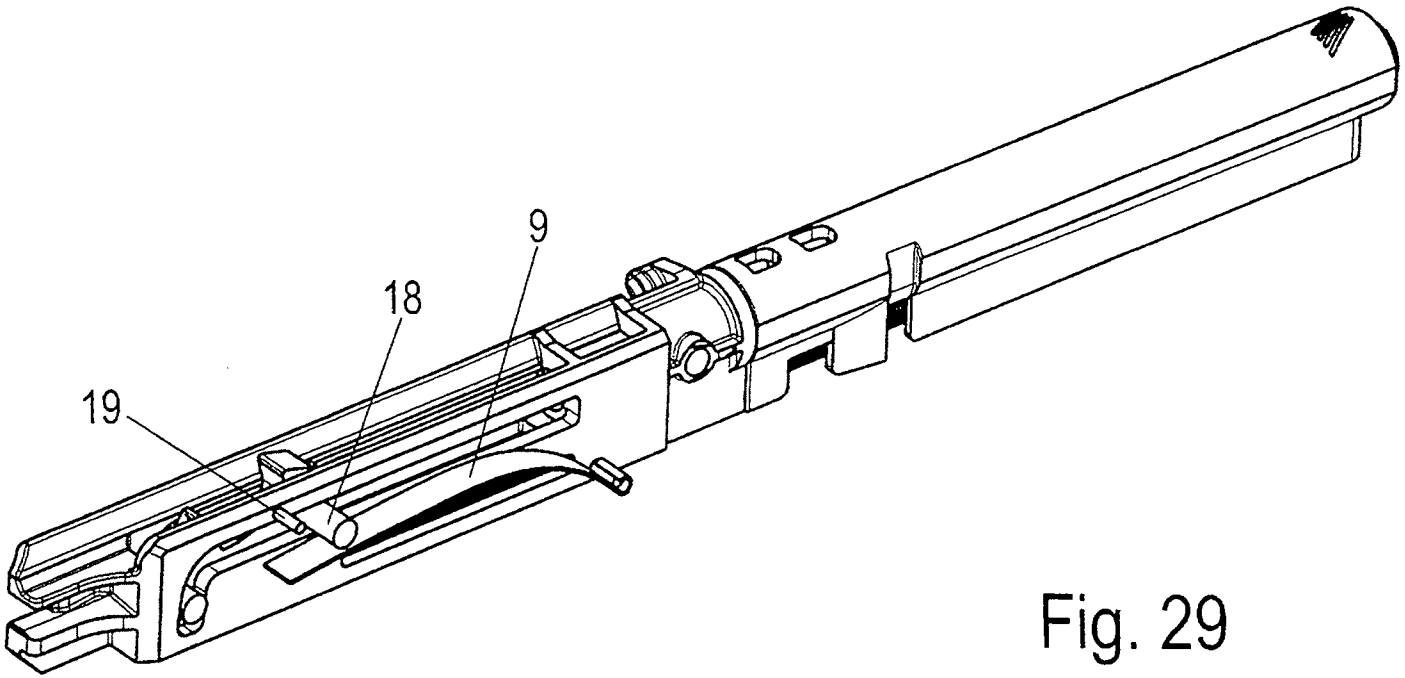
Figure 30:
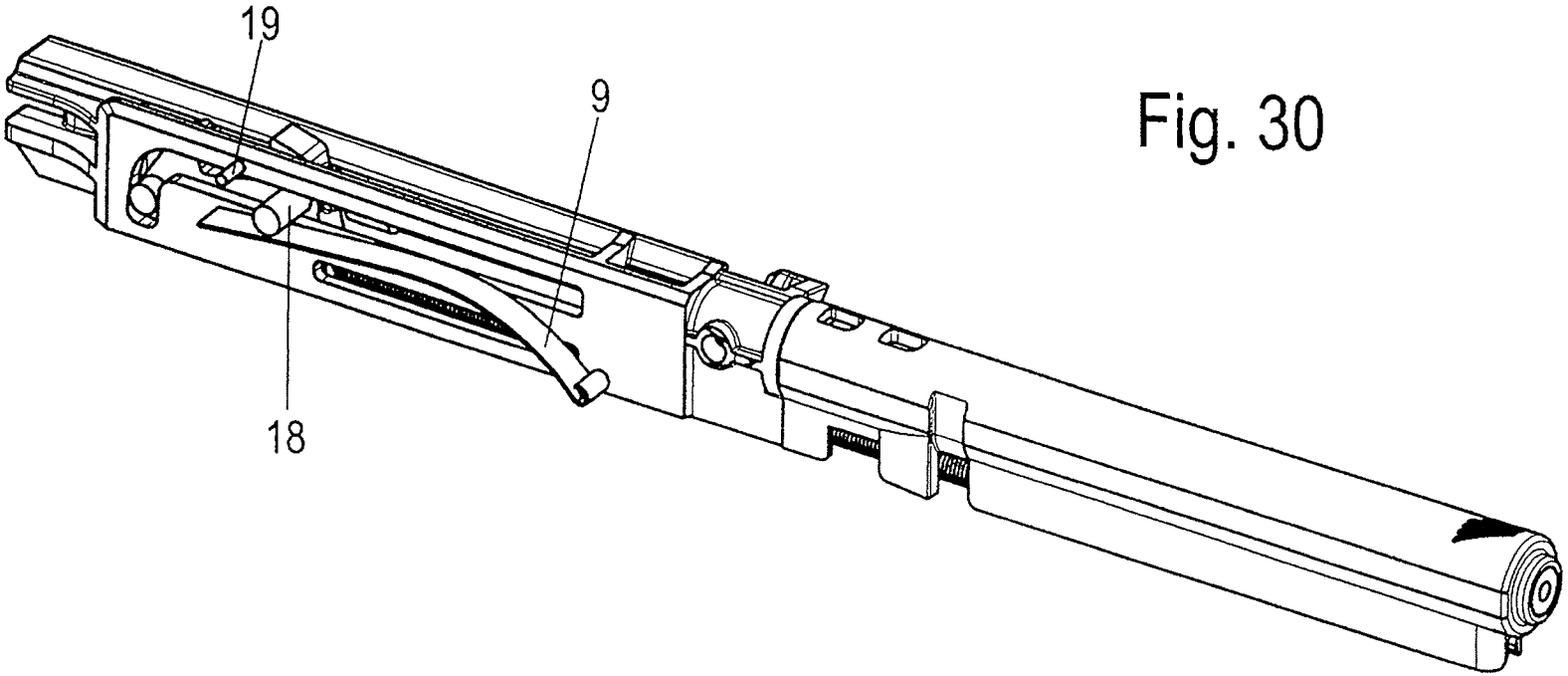
Figure 31:
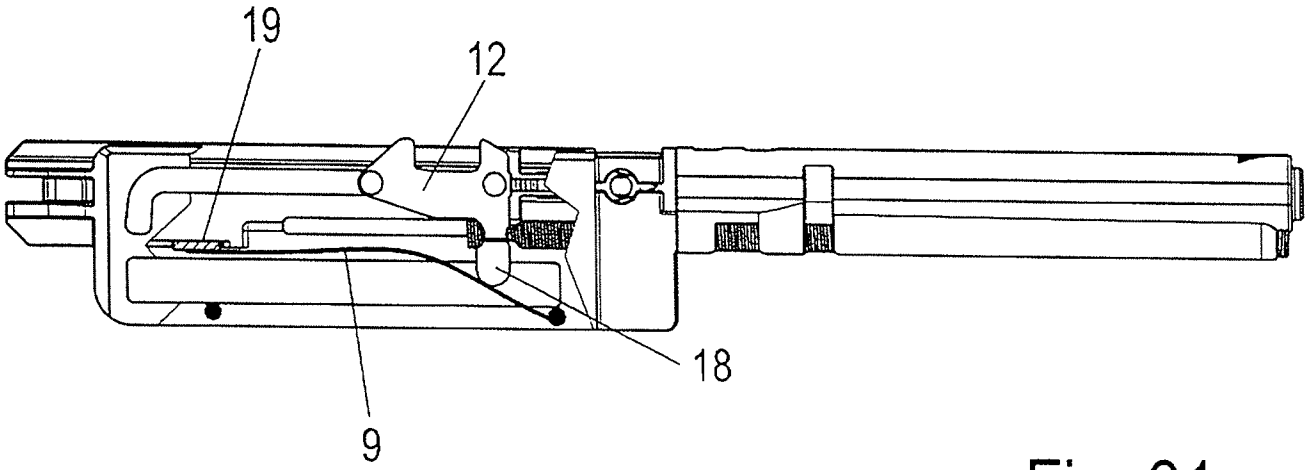
FIG. 31 shows a view of a sixth retraction device having a partially cutaway housing, the pullout guide being in the closed state of the drawer, according to the present disclosure.
Figure 32:
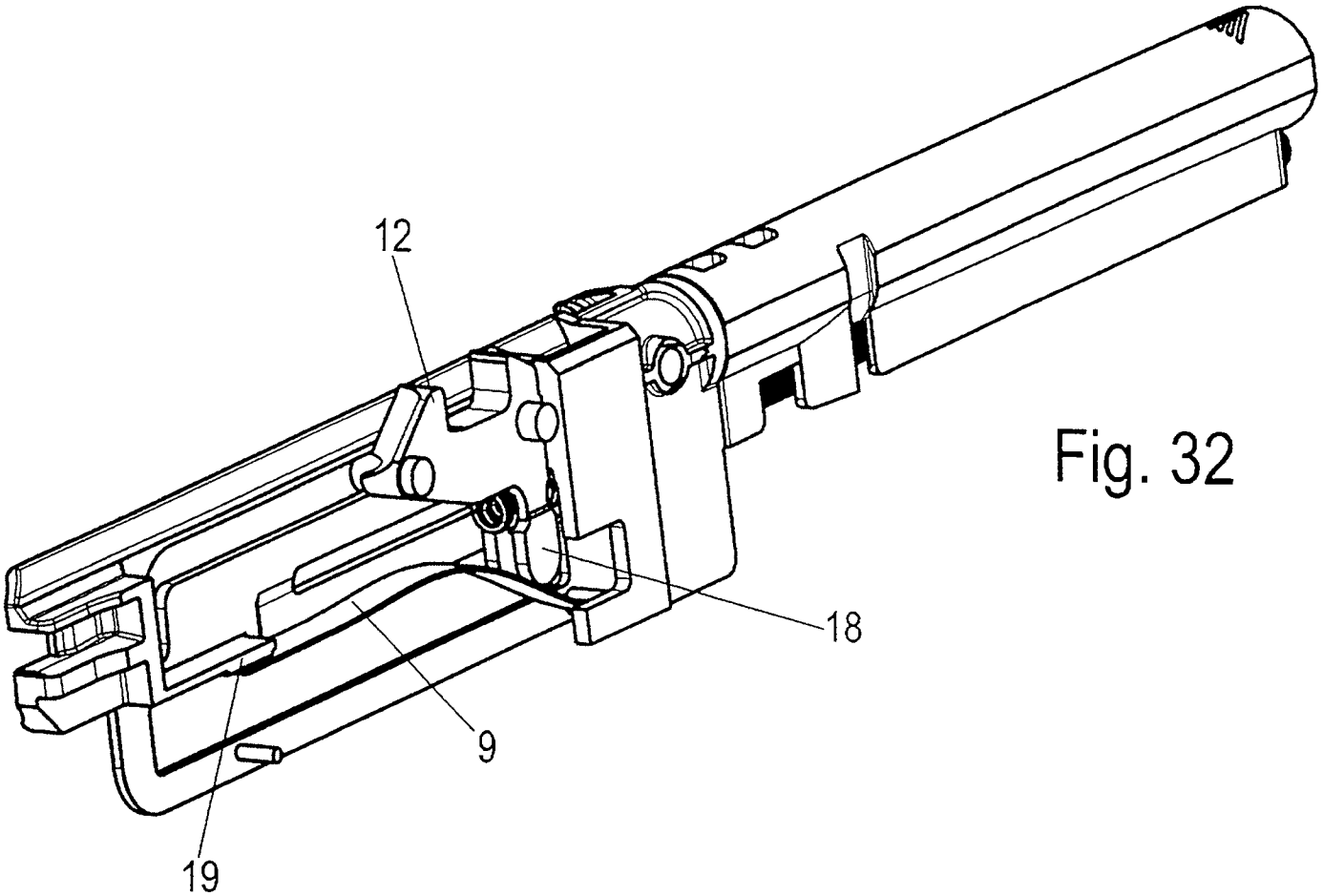
FIGS. 32-35 show views of the retraction device of the pullout guide of FIG. 31.
Figure 33:
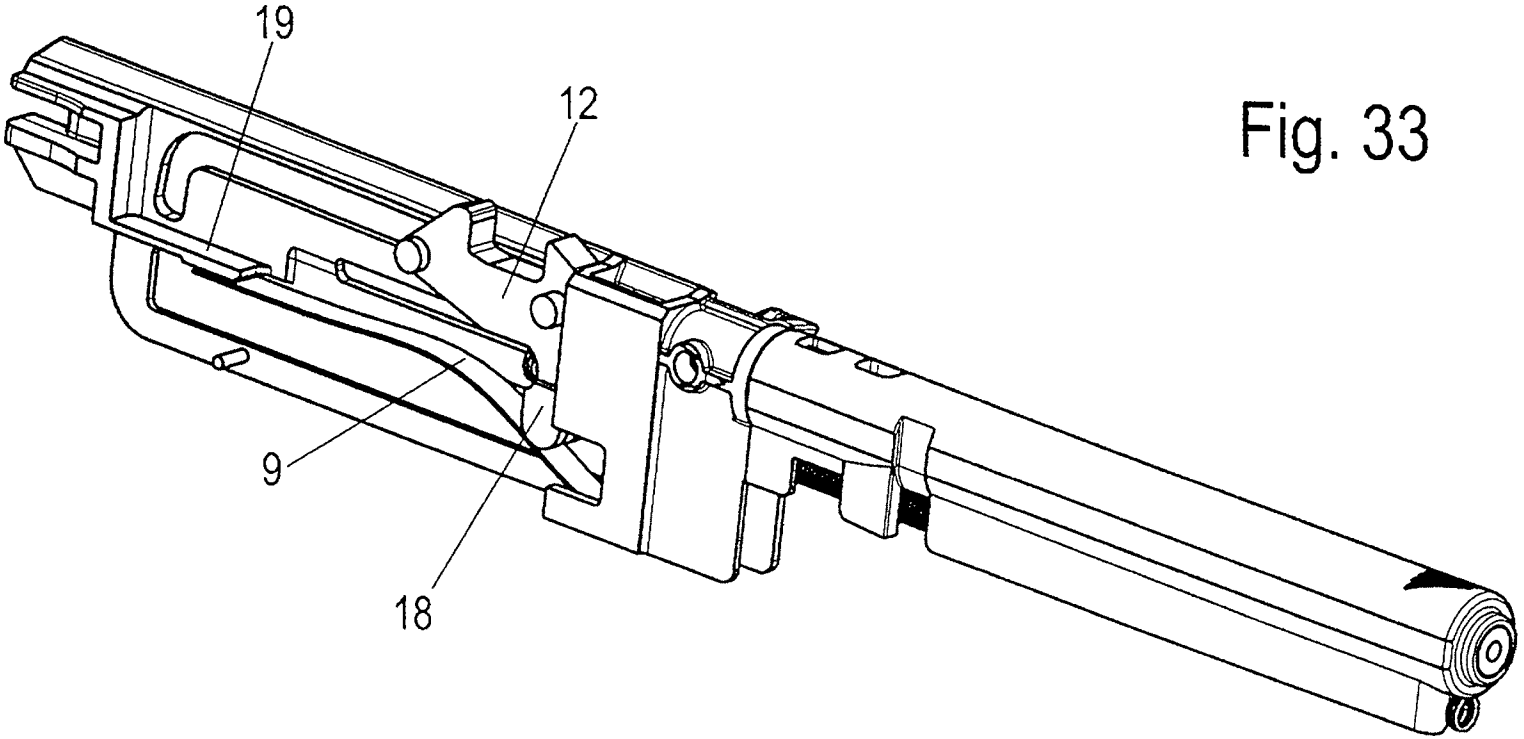
Figure 34:
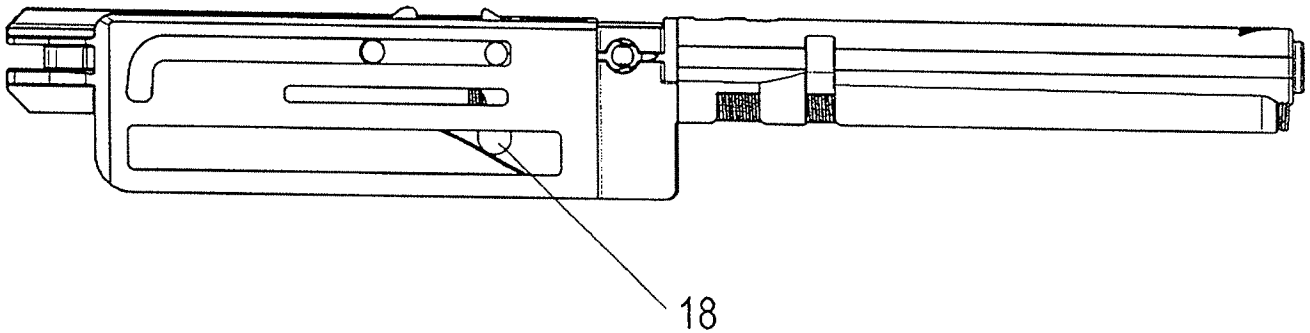
Figure 35:
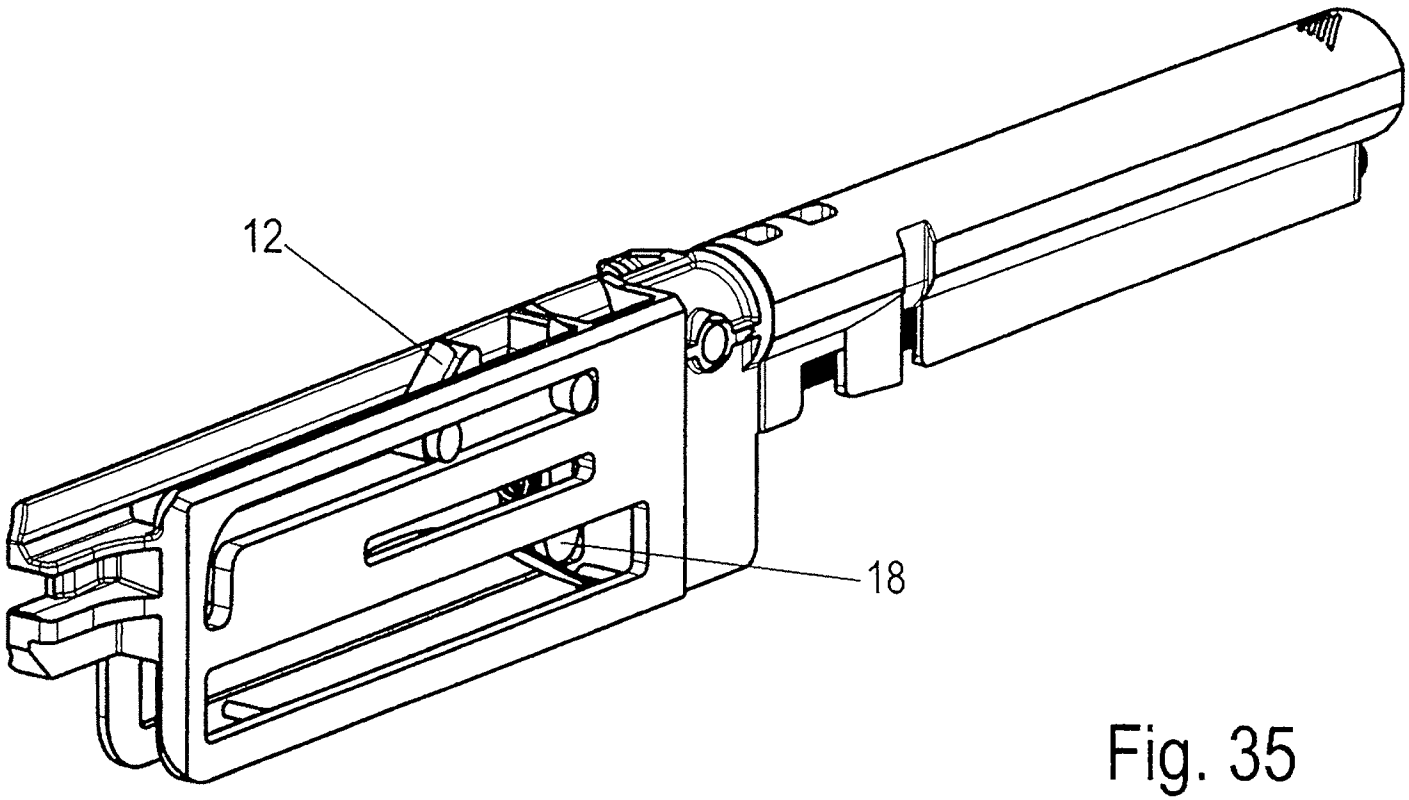
Figure 36:
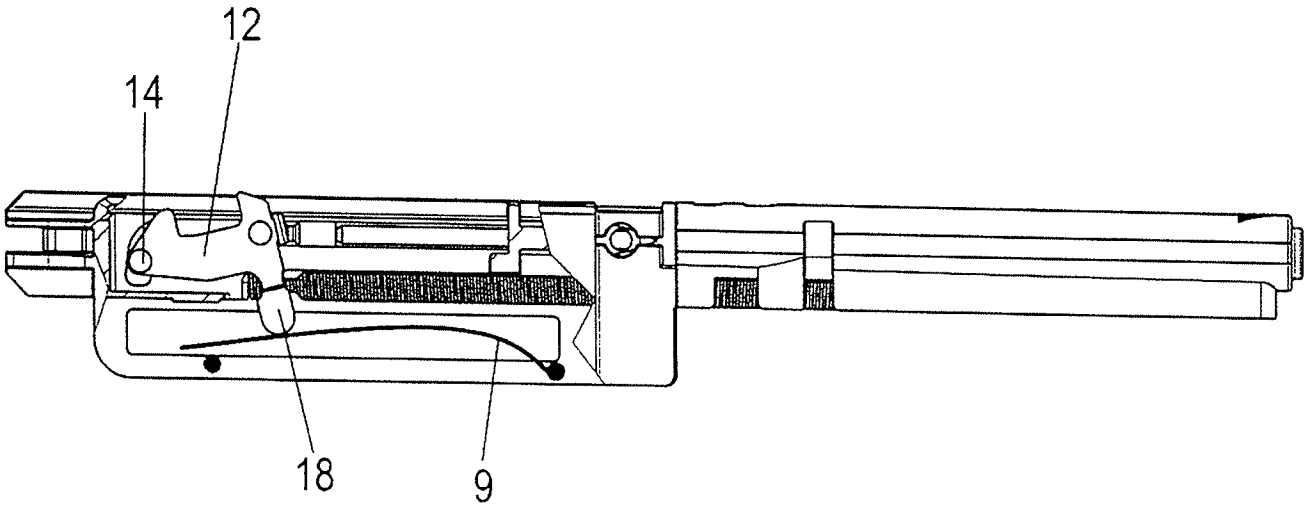
FIGS. 36-38 show views of the retraction device of the pullout guide of FIG. 31, the pullout guide being in the slightly open state of the drawer, according to the present disclosure.
Figure 37:
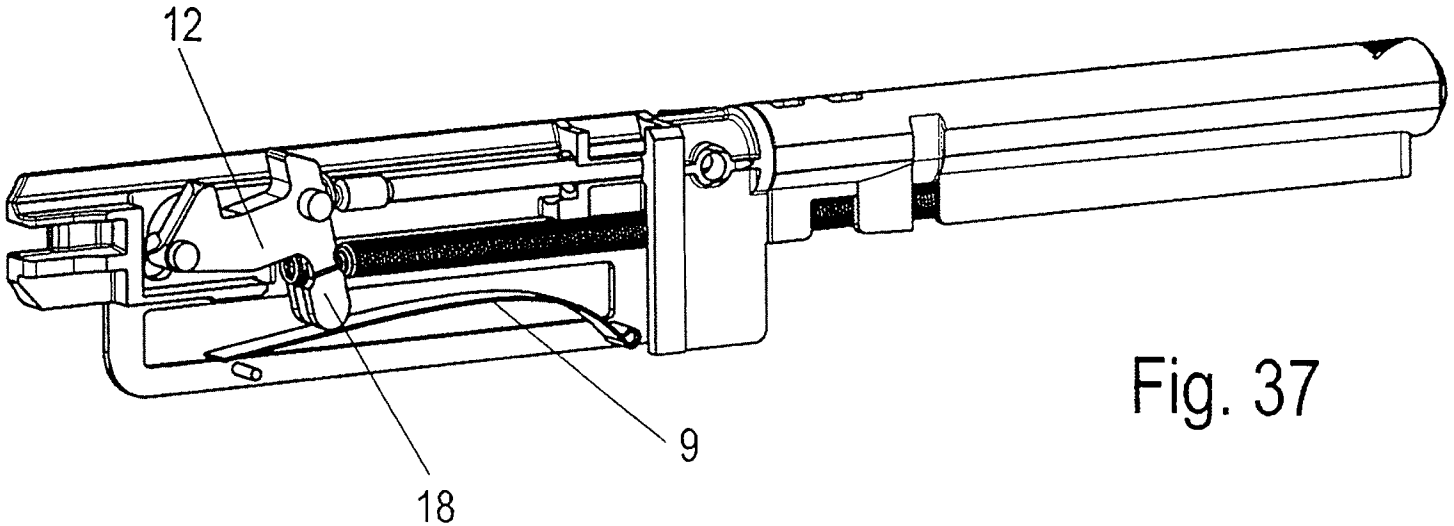
Figure 38:
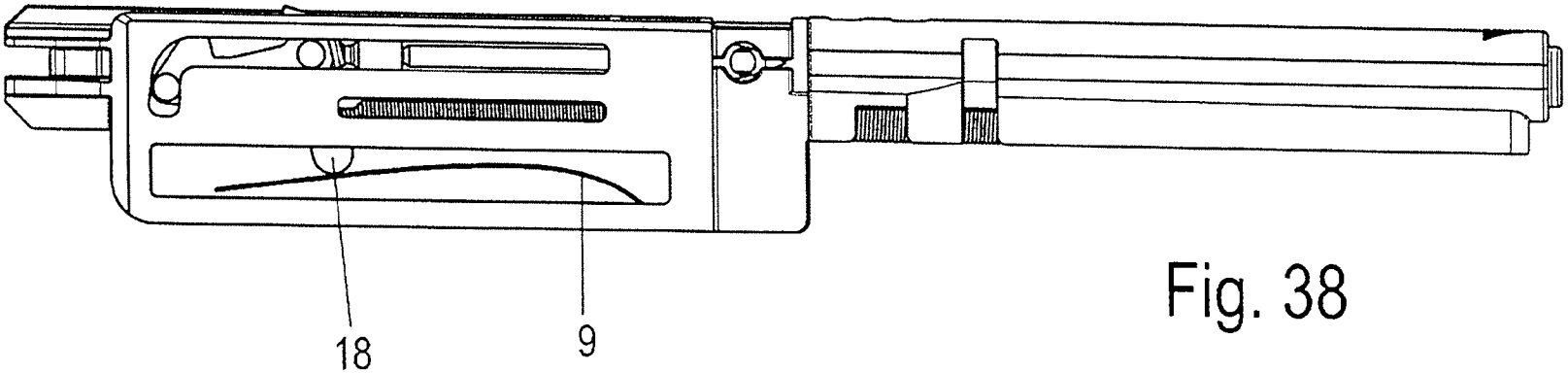

The first spring 8 of the spring configuration is designed here as a coiled spring, whose longitudinal axis is oriented parallel to the pullout direction X, according, for example, to FIG. 17.

The front end of this coiled spring 8 in the pullout direction X is fixed on the slide 12 and the other end is fixed on the base 11.

The retraction device 6 may, for example, function as next described.

When the furniture pullout part is pulled out, the slide rail 4 is moved in the pullout direction X, the driver 16 carrying along the slide 12 and tensioning the spring 8. As it is pulled out further, the slide 12 moves in the curved section 15*b*, which is oriented in such a way to the extension direction,—shown transversely, that the slide 12 pivots into the curved section 15*b*, in which it remains locked, as it is pulled out further.

In this state, the spring 8 is in the tensioned state and the furniture pullout part can be pulled out further.

When the furniture pullout part is pushed in, the retraction device 6 is initially inactive. As soon as the driver 16 on the slide rail 4 engages in the receptacle 13 again and the slide 12 moves back from the curved section 15*b* into the linear section 15*a*, however, the first spring 8 supports the retraction of the furniture pullout part into its closed position.

It is within the scope of the present disclosure to couple the slide 12 to a fluid damper 17, in order to damp this retraction movement (not shown in detail).

It is provided, according to the present disclosure, that the spring configuration 7 is supplemented with at least one second spring 9, which acts between the base 11 and the slide 12.

In accordance with the present disclosure, a parallel circuit of the at least two springs 8, 9 is provided.

The springs 8, 9 which are shown herein, have different spring characteristic curves.

Spring 8 may be designed as a coiled spring. Because of the force-distance characteristic of the coiled spring, which may act as a tension spring (see FIG. 39), the retraction force has a maximum at the beginning of the retraction procedure and then decreases. This has the result that the retraction force is relatively high at the beginning of the retraction and is relatively weak toward the end of the retraction.

The second spring 9 counteracts this effect.

This spring 9 is designed and installed such that it has a different resulting spring characteristic curve than the first spring 8 in the installed state in the horizontal direction, for example, the direction X during retraction. A nearly uniformly acting retraction or pullout force is thus achieved.

This may be implemented easily in that a torsion spring 9 is used as the second spring 9, which is at least partially fixed on the base 11 and is at least partially coupled to the slide 12 (see, for example, FIGS. 1, 4, 7, 18, 24, 31).

According to an embodiment of the present disclosure shown, for example, in FIG. 1, the torsion spring 9, importantly, has a force-distance curve which increases with the retraction distance in relation to the horizontal force-distance curve.

In an embodiment of the present disclosure, a force-distance curve which is constant or even increases slightly with the retraction distance results therefrom (see FIGS. 39*a, b, c*).

The curved torsion spring 9 may, for example, be situated such that it pivots from a maximum curved position, in which its free end, which faces away from the base 11 and is oriented at an angle, as shown, for example, in FIG. 1, even transversely to the horizontal, into a position oriented at less of an angle to the horizontal or even into a horizontal position. It is within the scope of the present disclosure that the free end of the torsion spring 9 presses against a limiter 19 to minimize the installation space height.

Figure 13:
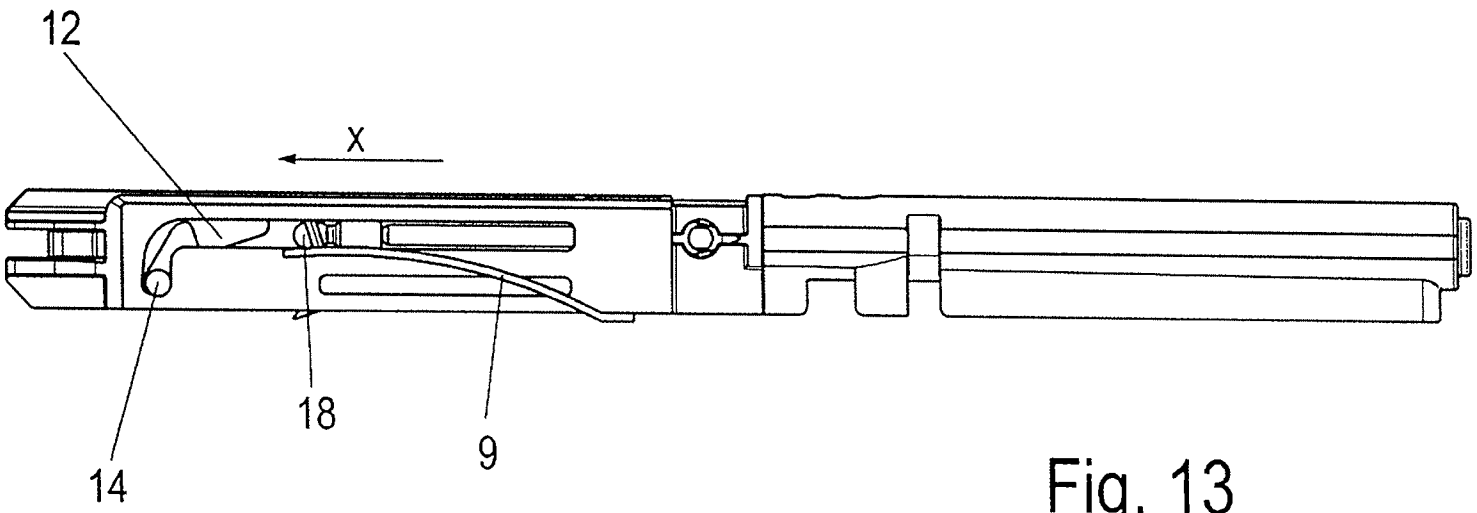
FIG. 13 shows a side view of the retraction device of the pullout guide from FIGS. 1 to 3 in a position which corresponds to a slightly open drawer.
Figure 14:
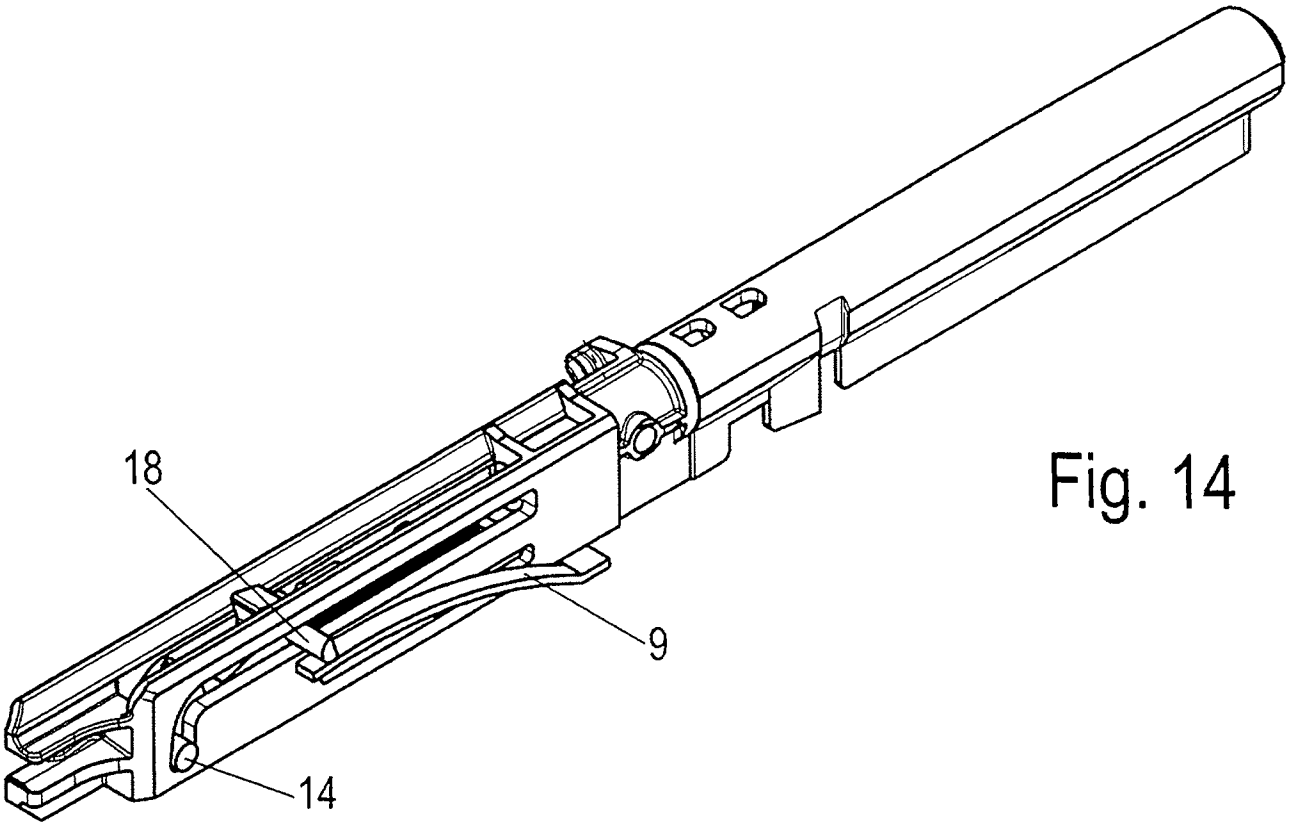
FIGS. 14 and 15 show perspective views of the configuration of FIG. 13.
Figure 15:
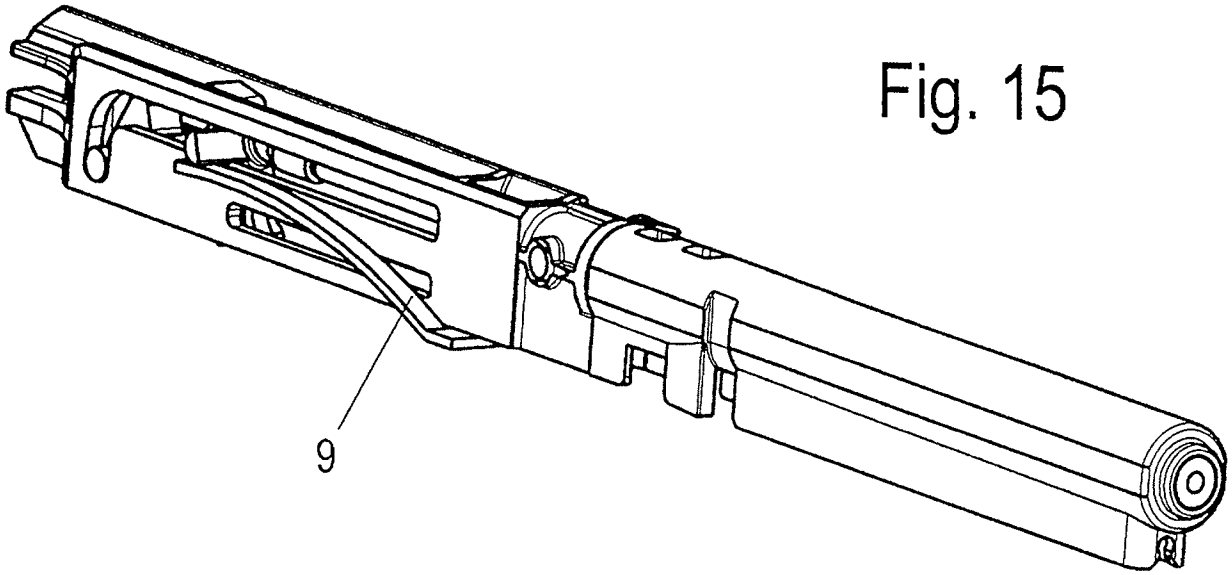

Such a configuration may be, for example, such that a pin 18 acts on the slide 12 at the free end of the torsion spring 9, the configuration being such that in the "park position" of the torsion spring 9, in which the pin 14 of the slide remains in the curved position 15*b*, the pin 18 holds the free end of the torsion spring 9 in the horizontal position (see, for example, FIGS. 13, 14, 15).

Figure 39:
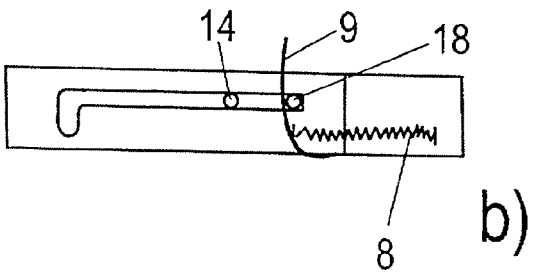
FIGS. 39*a-c* show two schematic views of a retraction device and a graph representing a mode of operation of the retraction device, according to the present disclosure.
Figure 39:
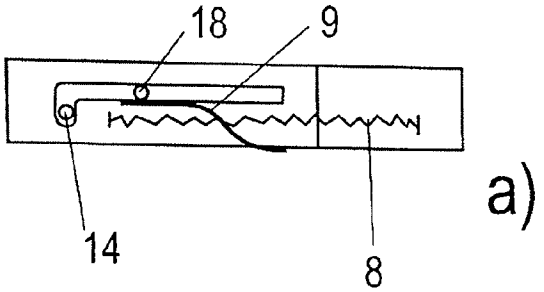
Figure 39:
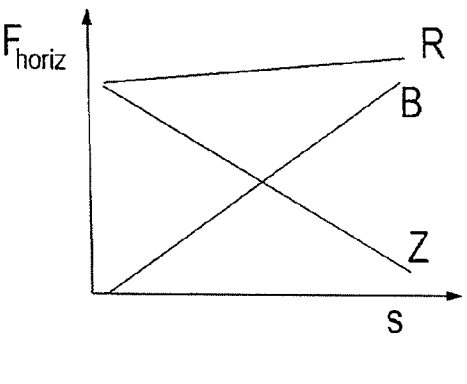

When the furniture pullout part is pushed in again, after the slide 12 is pivoted out of its park position in the curved section 15*b*, initially the first spring 8 essentially acts, to which the torsion spring 9 is connected in parallel, so that the spring force of the second spring 9 is added to the spring force 8 of the first spring (see FIG. 39).

Figure 7:
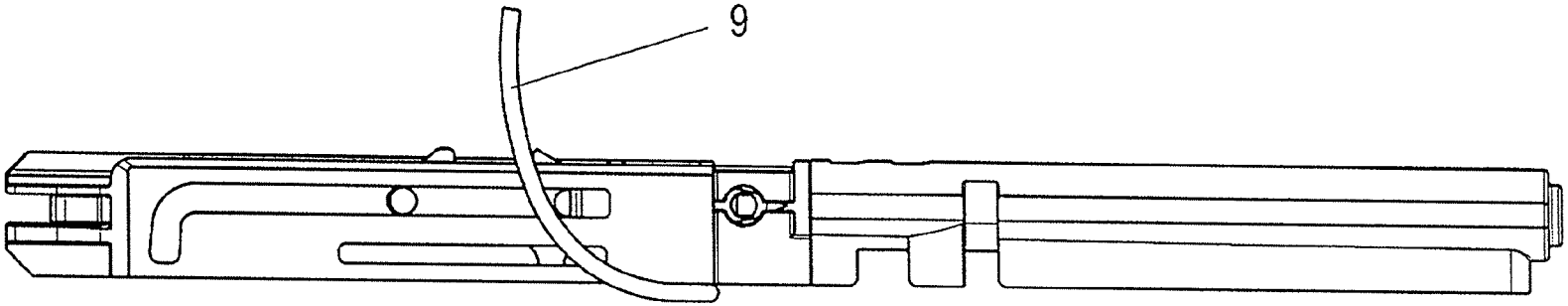
FIGS. 7-9 show various views of a third retraction device, according to the present disclosure, for a pullout guide of the type in FIG. 1.

According to the configuration of FIG. 1 or 7, the torsion spring 9 exerts a horizontal force component and a vertical force component on the pin 18 on the slide 12. The high vertical component at the beginning of the retraction movement increasingly changes into a horizontal component, so that the retraction force of the torsion spring 9 increases in the horizontal direction with the retraction distance.

According to embodiments of the present disclosure, the force-distance curve is thus significantly improved in a simple way over the prior art.

According to FIG. 1, the torsion spring 9 is formed from a flat strip, for example, from a sheet-metal strip made of spring steel. However, it is within the scope of the present disclosure to form it from a wire, thus from a round wire made of a spring steel (see FIGS. 4-9). Other cross-sectional geometries, such as square or oval, for example, are within the scope of the present disclosure.

It is within the scope of the present disclosure to bend the torsion spring 9 into a basic contour which deviates from the shape of a single curve. The torsion spring 9, according to FIGS. 4 to 6, is thus bent into a S-shape.

In this way, the second spring 9 can even be used for the purpose of initially reducing the force of the first spring 8 somewhat during retraction.

FIGS. 1 to 3 show a pullout guide having a retraction device 6 having a torsion spring 9 having a rectangular cross-section, the torsion spring 9 and the coiled spring 8, acting here as a tension spring, both being in the nearly relaxed state.

Figure 5:
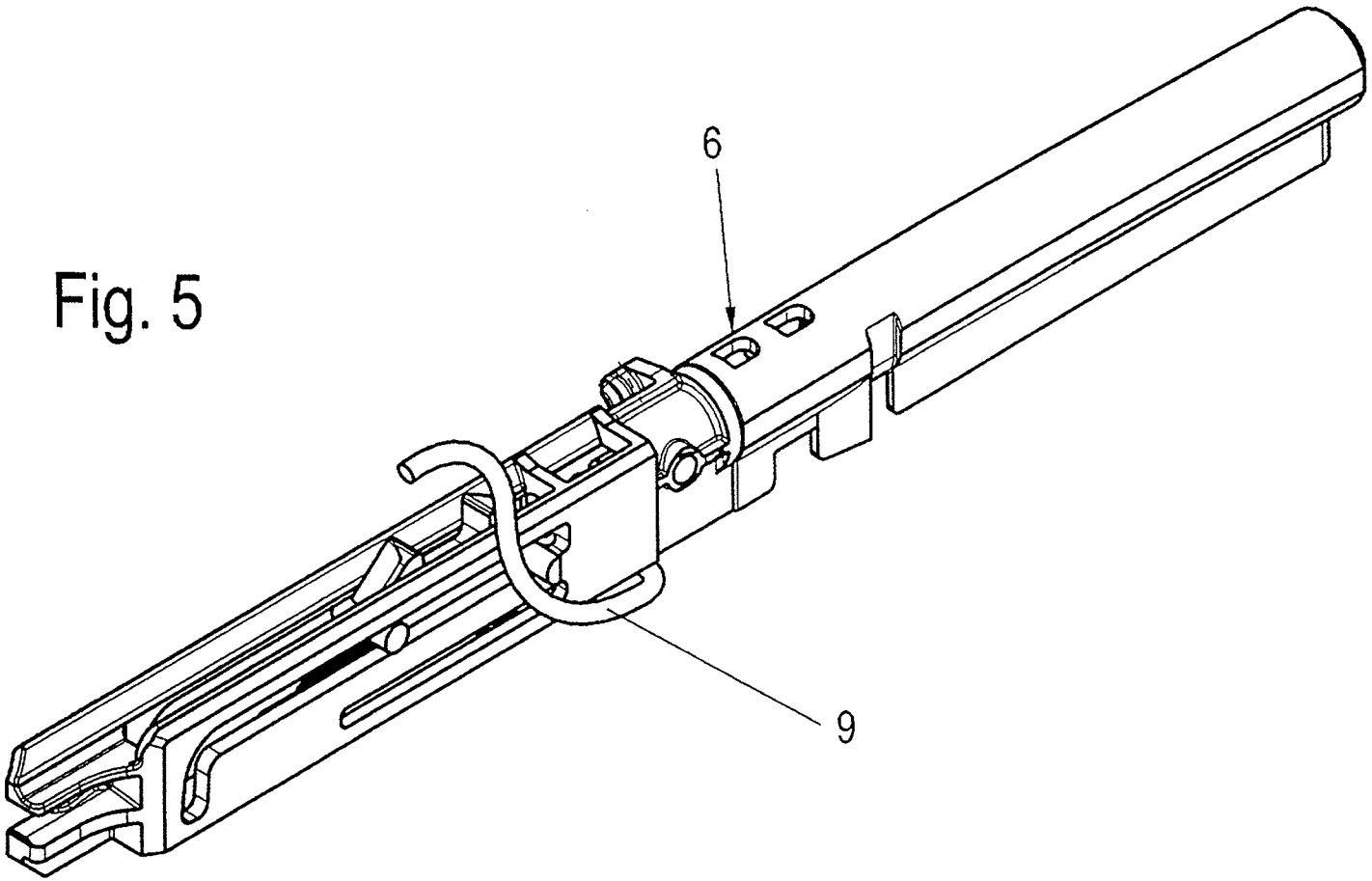
Figure 6:
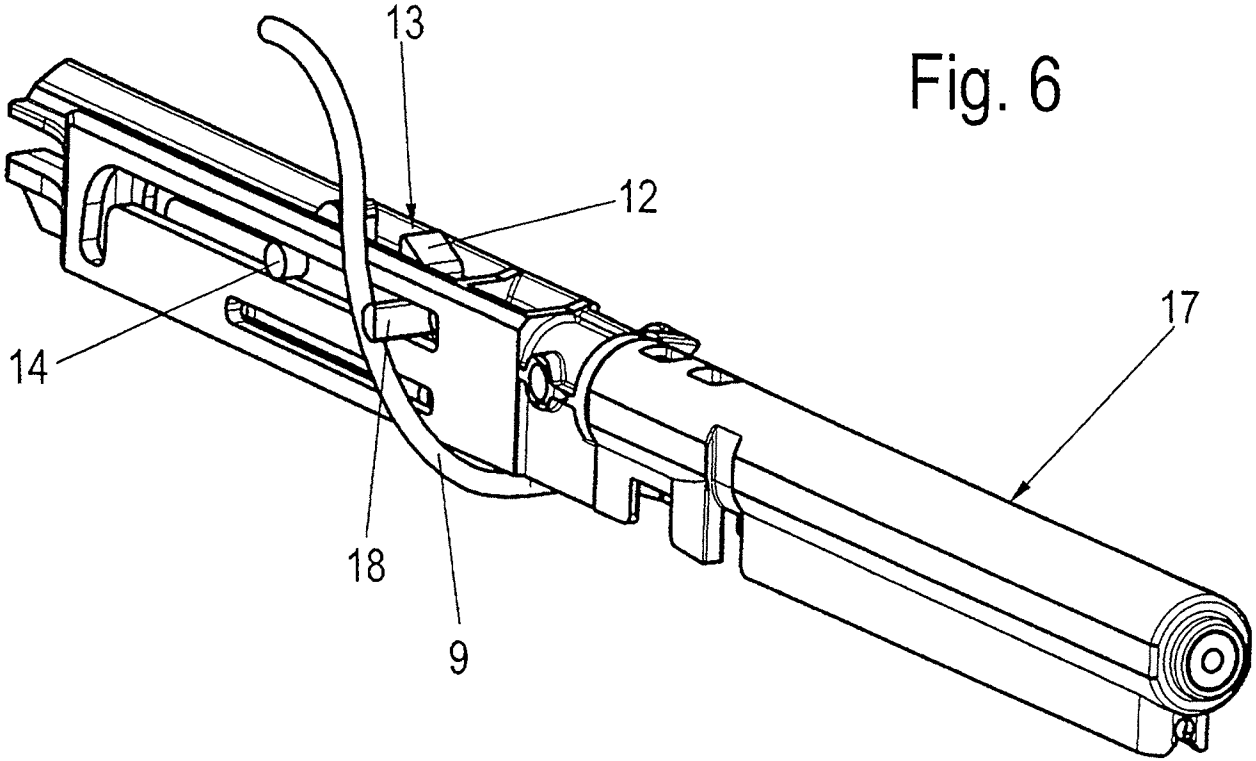

In contrast, FIGS. 4 to 6 show a retraction device 6 having an S-shaped torsion spring 9 having a round cross-section in a nearly relaxed position, similar to FIGS. 1 to 3.

Figure 8:
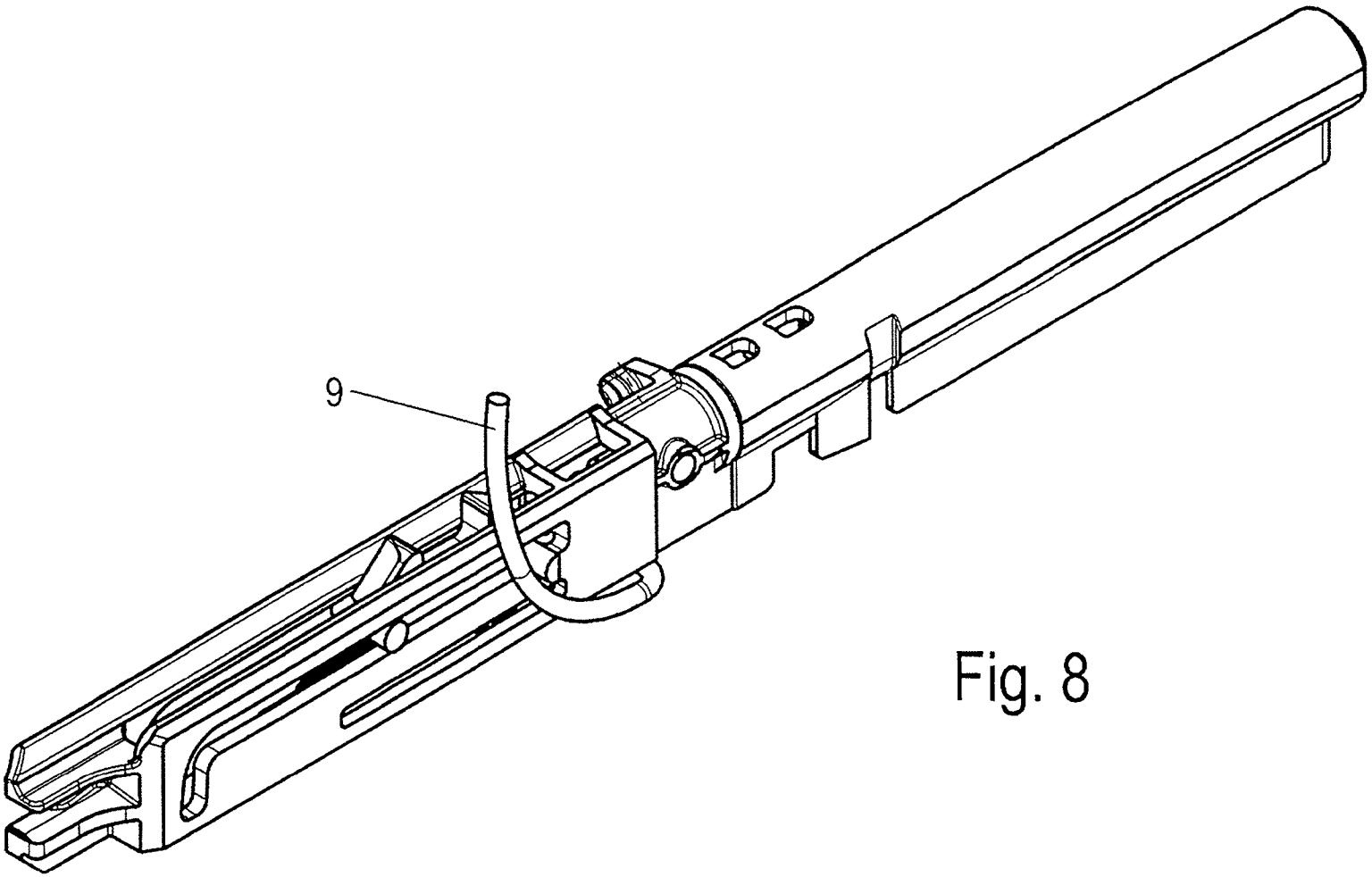
Figure 9:
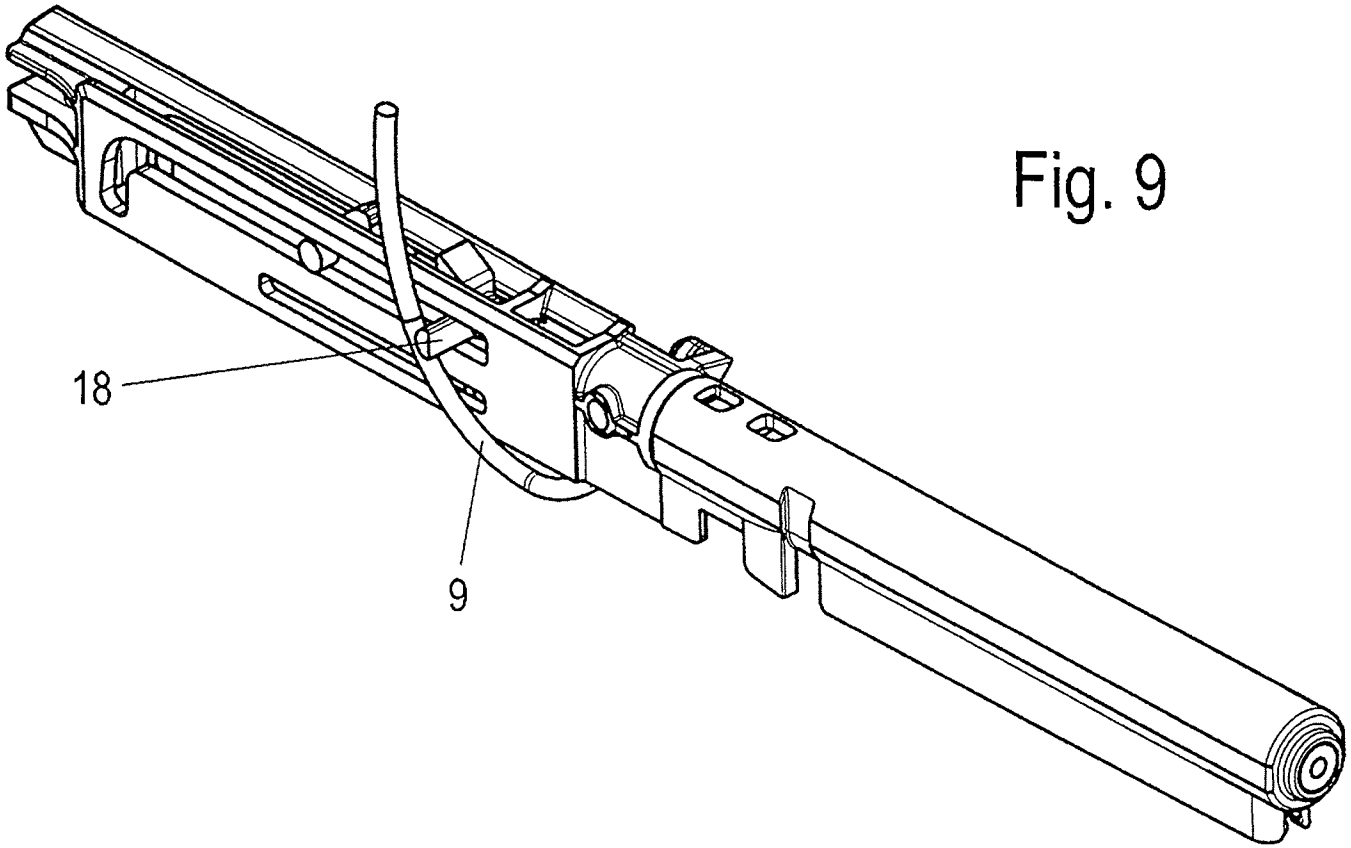

FIGS. 7 to 9 show a retraction device having a single-curved torsion spring 9 having a round cross-section in a nearly relaxed position similar to FIGS. 1 to 3.

Figure 10:
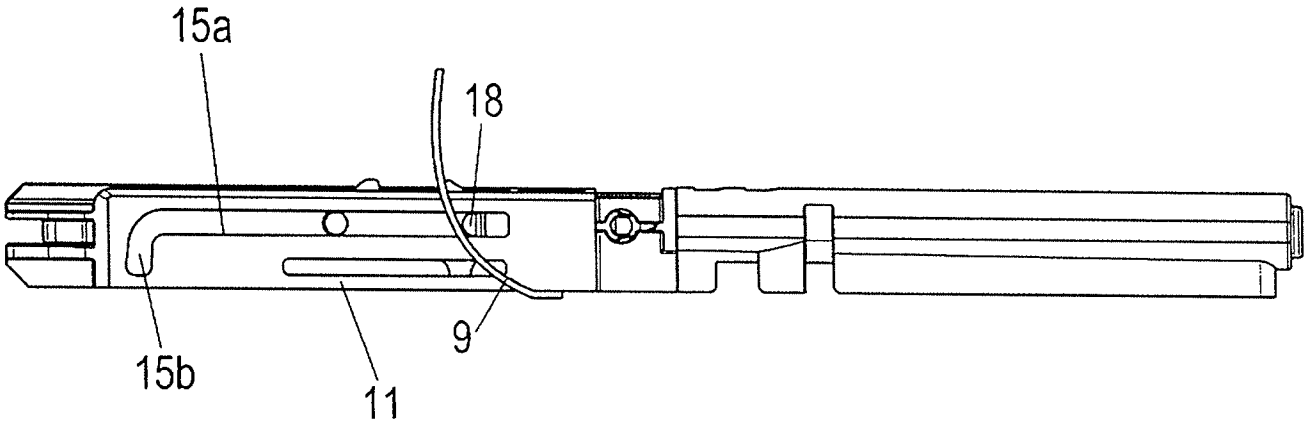
FIGS. 10-12 show views of the retraction device of the pullout guide from FIG. 1 similar to FIGS. 4 to 6.
Figure 11:
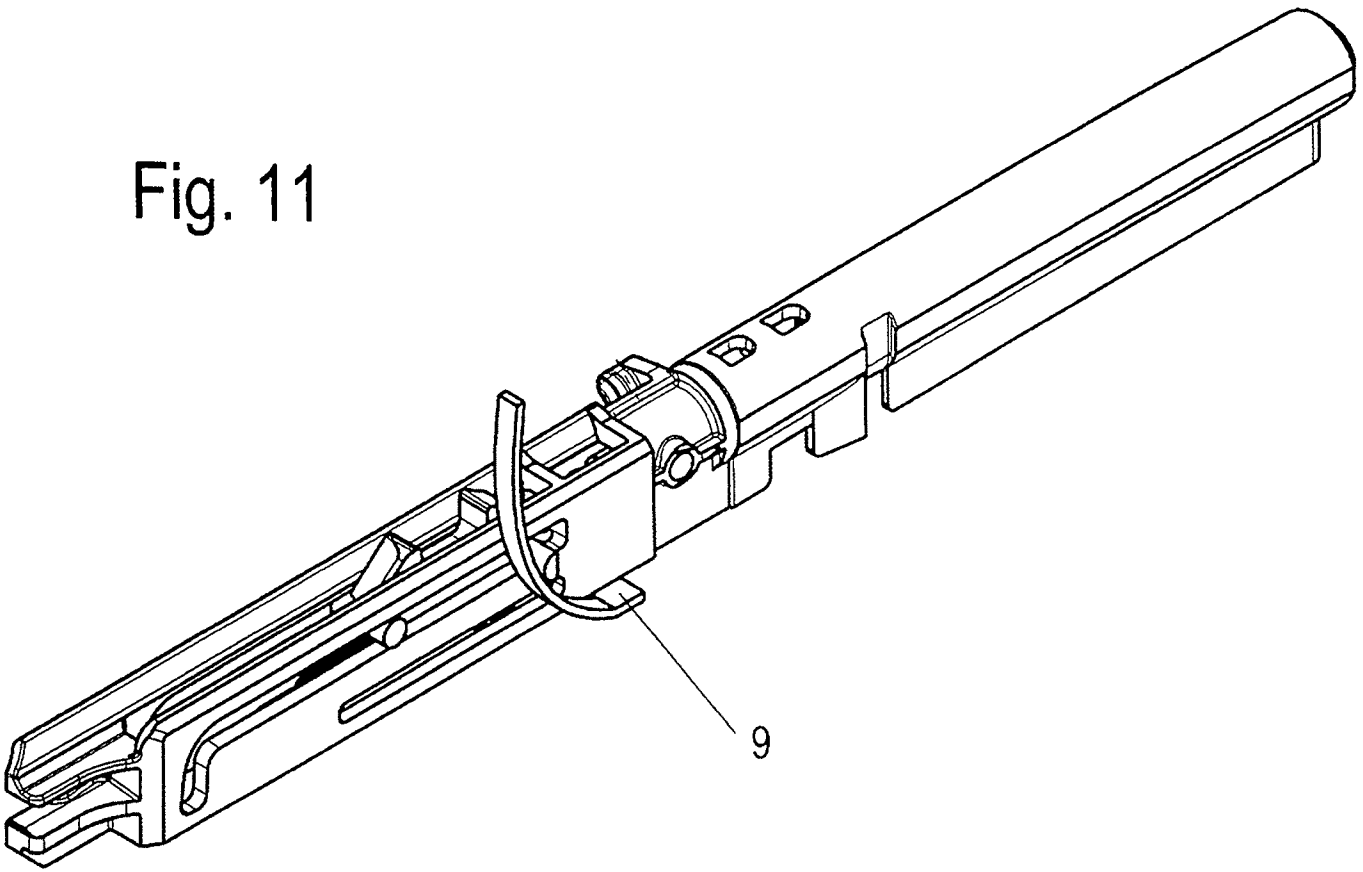
Figure 12:
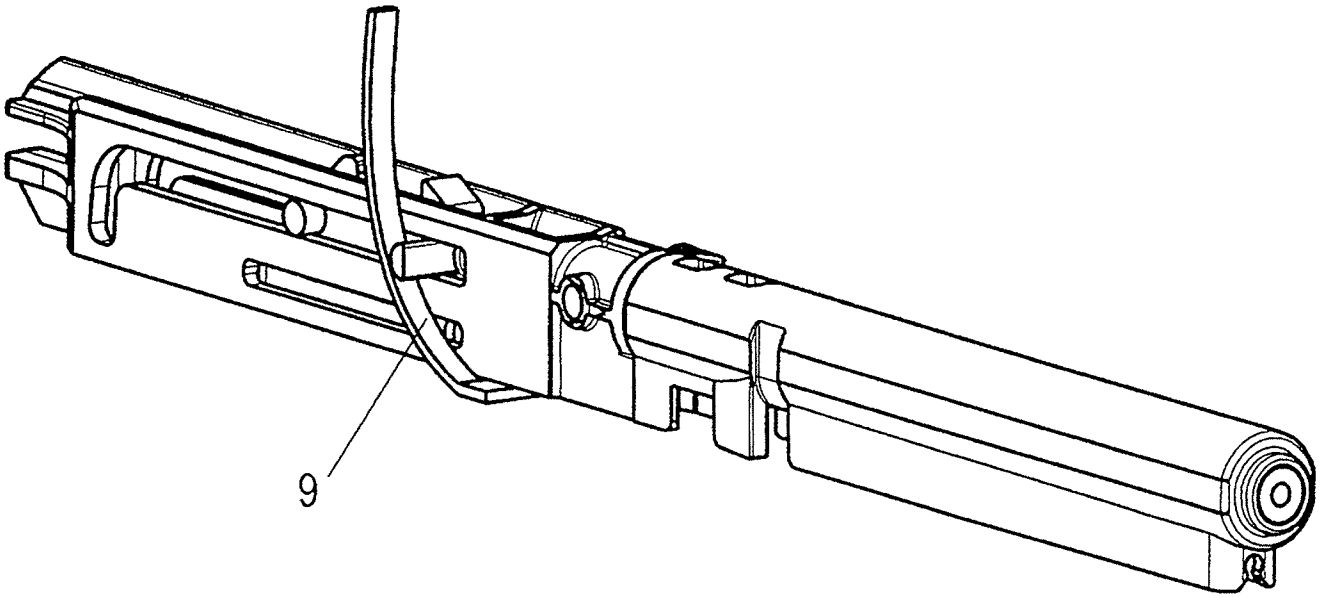

FIGS. 10 to 12 show the retraction device 6 of FIG. 1 having closed drawer and the rectangular torsion spring 9 and the coiled spring 8 in the nearly relaxed state, while, in contrast, FIGS. 13 to 15 show the tensioned state of the torsion spring 9 and the tension spring 8, the drawer being open.

As shown in FIGS. 17 to 23, according to an embodiment of the present disclosure, the two ends of the torsion spring 9 can also be fixed spaced apart on the base 11, so that they have a bending area between their ends, since it is longer than the spacing of the fixing areas on the base 11, on which the pin 18 acts. Individual areas of the torsion spring 9 can, according to the present disclosure, be equipped with different spring characteristic curves by special manufacturing methods like a constant force spring. In order to achieve the desired effect here, the traveling torsion or bending shaft 20, which results because of the slide movement of the pin 18, is located in front of the pin 18. The total retraction force of the spring configuration 7, including springs 8, 9, can thus be increased with increasing retraction distance and a nearly constant force-distance characteristic can be achieved, according to the present disclosure, by the targeted conditioning of the second spring 9.

As shown in FIGS. 24 to 30, according to an embodiment of the present disclosure, the torsion spring 9 can also be fixed at one end on the base 11 and the other end can press against a limiter 19, so that the installation space height is kept low.

FIGS. 31 to 38 show a retraction device in which the second spring 9 is deformed via the pin 18, which is implemented in this embodiment as an extension of the slide 12. As in a previous embodiment, one end of the second spring 9 is fixed on the base 11 and the other end presses against the limiter 19. The second spring 9, the limiter 19, and the pin 18 implemented on the slide 12 are integrated in the base 11, so that a compact construction results.

It is to be noted that each of the two springs 8, 9 connected in parallel, can, in accordance with the present disclosure, comprise a series circuit of two or more springs.

In addition, it is within the scope of the present disclosure to connect more than two springs in parallel to one another.

In addition, it is within the scope of the present disclosure to combine the functions of the pins 14 and 18 into only one pin (not shown). It is within the scope of the present disclosure that the identification of a pin may include any element acting from the slide 12 on the spring 9. It is within the scope of the present disclosure to have the pin 18 protrude from both sides of the base 11 and to fix a second spring 9 on both sides on the base 11, to counteract possible tilting of the slide 12.

It is within the scope of the present disclosure that the slide 12 may be coupled to the body or slide rail 3 and the base 11 may be coupled to the guide rail 10 (not shown) or a middle rail. Configurations of the base 11 directly on the body 3 or on the movable furniture part are within the scope of the present disclosure.

Furthermore, it is within the scope of the present disclosure to use a compression spring instead of the tension spring 8 as the first spring and/or to use another suitable spring instead of the coiled spring (not shown).

Although the present disclosure has been described and illustrated in detail, it is to be clearly understood that this is done by way of illustration and example only and is not to be taken by way of limitation. The scope of the present disclosure is to be limited only by the terms of the appended claims.

I claim:

1. A pullout guide for a furniture pullout part configured to be pulled out from a piece of furniture over a predefined pullout distance, the pullout guide comprising:

a retraction device configured to retract the furniture pullout part at least over a portion of the predefined pullout distance;

the retraction device including a spring configuration having a first coiled spring and a second torsion spring connected in parallel with respect to each other;

wherein the second torsion spring acts as one of a tension and compression spring during a retraction of the furniture pullout part;

wherein the second torsion spring is formed from a spring steel wire bent into an S-shape;

wherein each of the first and second springs includes a different spring characteristic curve than the other spring;

wherein each of the springs acts in an opening and a closing direction of the pullout guide, and closing direction forces of the two springs are additive; and wherein each of the different sprint characteristic curves includes a different force-distance characteristic acting in the pullout direction of the pullout guide.

2. The pullout guide according to claim 1, wherein the first coiled spring acts as one of a tension and compression spring during a retraction of the furniture pullout part.

3. The pullout guide according to claim 1, wherein the first and second springs include different horizontal force-distance characteristics.

4. The pullout guide according to claim 1, wherein the spring steel wire has one of a rectangular and round cross-section.

5. The pullout guide according to claim 1, wherein the spring steel wire is bent into a single-curved shape.

6. The pullout guide according to claim 1, wherein the retraction device includes a base and a slide, and the first and second springs are at least partially fixed on the base and at least partially coupled to the slide.

7. The pullout guide according to claim 1, wherein a retraction force of the first spring decreases over an active retraction distance of the first spring with the retraction of the furniture pullout part.

8. The pullout guide according to claim 1, wherein a retraction force of the second spring increases with a retraction of the furniture pullout part over a portion of an active retraction distance of the second spring.

9. The pullout guide according to claim 1, wherein a retraction force of the second spring is initially negative over an active retraction distance of the second spring and then increases with a retraction of the furniture pullout part.

10. The pullout guide according to claim 1, wherein the retraction device further includes a slide and a pin and the pin acts on the torsion spring such that the torsion spring is pressed down by the pin in a maximum pullout position of the slide.

11. The pullout guide according to claim 10, wherein the torsion spring has two spaced-apart ends, the torsion spring is fixed on a housing via said spaced apart ends, said torsion spring has a bending area between the two ends, and the pin acts on said bending area.

12. A pullout guide for a furniture pullout part configured to be pulled out from a piece of furniture over a predefined pullout distance, the pullout guide comprising:

a retraction device configured to retract the furniture pullout part at least over a portion of the predefined pullout distance;

the retraction device including a spring configuration having a first coiled spring and a second torsion spring connected in parallel with respect to each other;

wherein the second torsion spring acts as one of a tension and compression spring during a retraction of the furniture pullout part;

wherein the retraction device further includes a slide and a pin and the pin acts on the torsion spring such that the torsion spring is pressed down by the pin in a maximum pullout position of the slide;

wherein the torsion spring has two spaced-apart ends, the torsion spring is fixed on a housing via said spaced apart ends, said torsion spring has a bending area between the two ends, and the pin acts on said bending area;

wherein each of the first and second springs includes a different spring characteristic curve than the other spring;

wherein each of the springs acts in an opening and a closing direction of the pullout guide, and closing direction forces of the two springs are additive; and wherein each of the different sprint characteristic curves includes a different force-distance characteristic acting in the pullout direction of the pullout guide.

* * * * *

UNITED STATES PATENT AND TRADEMARK OFFICE

CERTIFICATE OF CORRECTION

PATENT NO. : 8,770,683 B2
APPLICATION NO. : 13/203150
DATED : July 8, 2014
INVENTOR(S) : Daniel Rehage It is certified that error appears in the above-identified patent and that said Letters Patent is hereby corrected as shown below:

In the Claims:

Please amend claim 1 as follows:

claim 1, at column 7, line 47, delete the word "sprint" and add the word "spring" in its place;

Please amend claim 12 as follows:

claim 12, at column 8, line 55, delete the word "sprint" and add the word "spring" in its place.

Signed and Sealed this
Thirtieth Day of September, 2014

Michelle K. Lee

Michelle K. Lee
*Deputy Director of the United States Patent and Trademark Office*